United States Patent [19]

Nagy et al.

[11] Patent Number: 4,552,350

[45] Date of Patent: Nov. 12, 1985

[54] TRANSPORT FOR DIVERTED AND PURGED SHEETS IN A SHEET DISPENSER

[75] Inventors: Charles S. Nagy; Dale L. Placke, both of Dayton; Jack R. Gross, Waynesville; Robert H. Granzow, Miamisburg, all of Ohio

[73] Assignee: NCR Corporation, Dayton, Ohio

[21] Appl. No.: 594,452

[22] Filed: Mar. 28, 1984

[51] Int. Cl.[4] ..... B65H 5/22

[52] U.S. Cl. ..... 271/3; 271/3.1; 271/35; 271/212; 209/534; 414/33

[58] Field of Search ..... 271/3, 3.1, 35, 212; 221/176; 209/534; 414/32, 33

[56] References Cited

U.S. PATENT DOCUMENTS

| | | | |
|---|---|---|---|
| 4,017,004 | 4/1977 | Onoe | 271/212 X |
| 4,066,253 | 1/1978 | Lundblad et al. | 271/4 |
| 4,343,582 | 8/1982 | Lundblad et al. | 414/32 |
| 4,363,584 | 12/1982 | Kokubo | 414/33 |
| 4,428,501 | 1/1984 | Osako | 221/13 |
| 4,462,509 | 7/1984 | Adelberger | 271/3.1 X |

FOREIGN PATENT DOCUMENTS

| | | |
|---|---|---|
| 69588 | 10/1973 | Japan . |
| 2,005,639 | 4/1979 | United Kingdom . |
| 2073711 | 10/1981 | United Kingdom . |
| 2101384 | 1/1983 | United Kingdom . |

*Primary Examiner*—Richard A. Schacher

*Attorney, Agent, or Firm*—Albert L. Sessler, Jr.; Elmer Wargo

[57] ABSTRACT

A sheet dispenser in which sheets are delivered from cassettes to a collector and held thereon. The collector is mounted on a moveable support, and the collector and bills thereon are moved to either left or right delivery areas of the terminal in response to a request entered on an input terminal. Closures normally close the left and right delivery areas; however, these closures are opened to permit the sheets held on the collector to extend out of the dispenser to be grasped by an operator.

5 Claims, 19 Drawing Figures

445
524
532
528
19
548
521
558
546
550
522
19
459
534
526
530
520
544
F
542
540
538
536
73
75
574
75-1
73-1

TRANSPORT FOR DIVERTED AND PURGED SHEETS IN A SHEET DISPENSER

This application is related to Ser. Nos. 594,450, 594,451, and 594,453 which were filed on the same date as tbis application and were assigned to the same assignee as is this application.

BACKGROUND OF THE INVENTION

This invention relates to a system for dispensing cash, and more particularly, it relates to a system which enables a single currency dispenser to be utilized by two tellers in a typical banking environment.

In recent years there has been a trend to automate banking functions as they relate to bank customers. The Automated Teller Machines (ATMs) and currency dispensers are two examples of this automation. The currency dispensers are used, typically, in banks by tellers to facilitate the dispensing of currency. Any speeding up in the handling of customers in banks represents an important reduction in costs for the bank; this is a very important area in controlling a bank's cost and profitability.

SUMMARY OF THE INVENTION

This invention relates to a transport system for use with a sheet dispenser comprising: means for collecting sheets to be dispensed; a collecting bin positioned below said collecting means to receive sheets to be purged from said collecting means; a purge bin having an entrance thereto, with said entrance being located near the bottom of said purge bin; an endless belt means positioned at the bottom of said collecting bin to receive said sheets to be purged, with said endless belt means having a discharge end; said endless belt means and said entrance to said purge bin being positioned so that said discharge end is positioned adjacent to said entrance; means for moving said endless belt means in a direction which moves the sheets carried by said endless belt means into said entrance area; and bias means to resiliently bias said sheets against said discharge end of said endless belt means to facilitate the moving of said sheets into said entrance of said purge bin.

The sheet dispenser made according to this invention is relatively simple in construction and is designed to speed up the handling of currency, for example, in a bank.

The sheet dispenser made according to this invention is reliable and relatively inexpensive considering the saving in teller's time that it provides.

These advantages and others will be more readily understood in connection with the following description, claims and drawing.

DETAILED DESCRIPTION OF THE INVENTION

Figure 1:
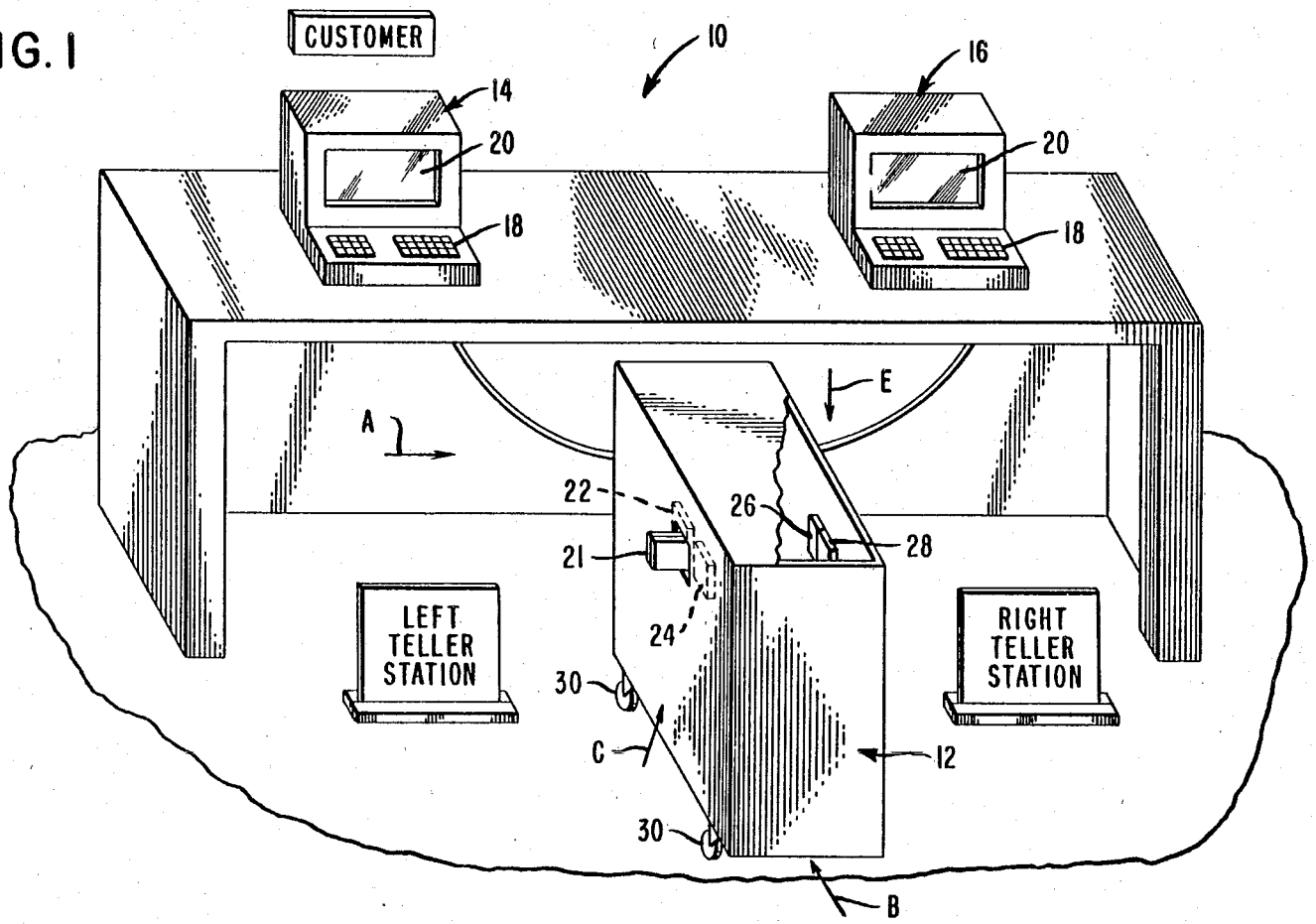
FIG. 1 is a general schematic view, in perspective, showing a preferred embodiment of the cash dispensing system in which this invention may be used; the system includes a cash dispenser and left and right terminals which are coupled to the cash dispenser.

FIG. 1 is a general schematic view, in perspective, of a preferred embodiment of the cash dispensing system of this invention which is designated generally as 10. While the system 10 is described in a banking environment for the dispensing of cash, for example, the system 10 may be used for dispensing sheets such as coupons, notes, or tickets, for example, where the dispensing of such sheets must be accurately controlled.

FIG. 1 shows the dispenser 12 as it is used in a banking environment. The dispenser 12 is coupled to an input terminal 14 which is located at a left teller station, and it is also coupled to an input terminal 16 which is located at a right teller station. The terminals 14 and 16 are conventional teller machines such as the NCR 2262 and the NCR 5062, for example, which are currently available from the NCR Corporation of Dayton, Ohio. The terminals 14 and 16 have keyboards 18 for entering data, and they also have displays like a cathode ray tube (CRT) 20 to enable the terminals 14 and 16 to communicate with human tellers located at the left and right teller stations, respectively. The terminals 14 and 16 serve as input devices to the dispenser 12. While the terminals 14 and 16 are operated by tellers, the dispenser 12 may also be coupled to two Automatic Teller Machines (ATM's) which would be operated by customers within the lobby of a bank, for example. The dispenser 12 dispenses currency from either a left side or a right side as shown in FIG. 1. Currency 21 is shown as being dispensed from the dispenser 12, waiting to be grasped by a teller at the left teller station. Sliding doors 22 and 24 are located on the left side (as viewed in FIG. 1) of the terminal 12 to act as closure to close off that side when not in use, and similarly, sliding doors 26 and 28 close off the right side. The dispenser 12 is mounted on wheels 30 to enable the entire dispenser 12 (after disconnecting it from the terminals 14 and 16) to be moved into a safe within the bank. This minimizes the need for certain banking reconciliation procedures at the end of the day; this aspect will be reviewed later herein.

Before discussing the details of the system 10, it appears appropriate to discuss, in general, how the system 10 works. In this regard, a typical transaction involving the dispensing of cash that a teller may be called upon to make may be that of cashing a check or withdrawing cash from a savings account. After the usual identification procedures, the teller enters the amount of currency desired on the keyboard 18 of terminal 14, for example, and actuates a function key 32 (FIG. 2) on the keyboard 18 to "dispense cash." The dispenser 12 then immediately begins the function of picking the appropriate number of bills of the various denominations of bills from the various currency cassettes #1–#5 locate within the dispenser 12, as shown in FIG. 3. The picked bills 21 are collected and delivered to the left side of the dispenser 12, in the example described, because the currency was requested by the terminal 14. While this description presently relates to the cashing of a check and the dispensing of currency, any coins associated with the check-cashing operation may be dispensed from conventional coin dispensers 34 and 36, as shown only schematically in FIG. 2. The currency 21 to be dispensed is gripped within the dispenser 12 by means to be later described herein, and the teller pulls the stack of currency 21 out of the dispenser 12 against the bias of this means and delivers the currency to the customer at the left teller station. Any coins required for the check-cashing operation would be found in the left coin dispenser 34 for delivery to the customer.

The process just described for a check-cashing operation by a teller at the left teller station (FIG. 1) is the same for a similar operation performed by a teller (at the right teller station) who enters data on the terminal 16. A feature of the present invention is that after the currency 21 is delivered to the teller at the left teller station, the dispenser 12 can begin to process another request for cash by the teller at the right station (via terminal 16) even though the teller at the left teller station has not removed the currency 21 from the dispenser 12. This feature will be described in more detail hereinafter.

Having described the general operation of the system 10 in a check-cashing operation, it appears appropriate to discuss the details of the dispenser 12. In the embodiment described, the dispenser 12 has cassettes numbered 1 through 5 as shown in FIG. 3. The bills like 38 in FIG. 3 are stacked with their long lower edges resting on a support within the cassette #1 and with the long dimension of the bills being perpendicular to the plane of FIG. 3. The cassettes #1–#5 are identical and conventional. Generally, the most-frequently-used denomination in currency dispensing is placed in cassette #1, and correspondingly, the least-frequently-used denomination is placed in cassette #5; however, the types of bills placed in each cassette and their locations within the dispenser 12 are determined by the associated bank. Each cassette #1–#5 has coupling means 40 (shown schematically as block 40 in FIG. 3) to inform the cash dispenser controller (designated generally as 42 in FIG. 2) as to the type of bills stored in the cassette and whether or not bills exist in the cassette. The coupling means 40 are conventional and may include coded magnetic identification couplers or sensing pins, for example. When a cassette #1–#5 is installed in the dispenser 12, the associated coupling means 40 informs the controller 42 as previously explained. This enables the cassettes #1–#5 to be placed in the dispenser 12 at positions other than the usual position for that particular denomination of bills.

Each of the cassettes #1–#5 (FIG. 3) has its own picker mechanism associated therewith, with picker mechanisms 44-1, 44-2, 44-3, 44-4, and 44-5 being associated with cassettes #1–#5, respectively. The picker mechanisms 44-1 through 44-5 are conventional, and they are used to pick a bill 38 from the front of the stack of bills in the cassette and transfer the picked bill past an associated sensor, like 46-1, to a bill transport or delivery system designated generally as 48. Each cassette #1–#5 has a sensor 46-1, 46-2, 46-3, 46-4, and 46-5, respectively, associated therewith; the functions of these sensors will be described hereinafter. The bills picked from the cassettes #1–#5 move up the bill delivery system 48 towards a diverter 50.

The bill delivery system 48 (FIG. 3) is comprised of drive rollers 52-1, 52-2, 52-3, 52-4, and 52-5, and is also comprised of their associated back-up rollers 54-1, 54-2, 54-3, 54-4, and 54-5, respectively; the system moves the bills from the associated cassettes #1–#5 towards the diverter 50. The drive roller 52-1 is coupled to the main driving motor 56 by suitable linkage like pulleys and a driving, timing belt shown only as dashed line 58, and all the remaining drive rollers 52-2 through 52-5 are similarly connected to drive pulley 52-1 to provide for timed rotation among these drive rollers. The cassettes #1–#5 are spaced equally along the bill delivery system 48 to facilitate modular construction of the dispenser 12. All the various components that have been described in FIG. 3 and that lie below the motor 56 in this figure are conventional and have been described only generally as they are generally similar to an NCR M80-05 picker unit which is used in an NCR Class 5080 ATM, for example, which is available from NCR Corporation.

Continuing with a general description of the dispenser 12, the diverter 50, alluded to earlier, is biased or pivoted into a diverting position by the tension spring 60. However, when bills are to be delivered to the stacker wheel 62, the actuator 64 is energized by the controller 42, causing the diverter 50 to pivot in a counter-clockwise direction (FIG. 3) about its pivot point 66 to the position shown in FIG. 3. When the actuator 64 is de-energized, the spring 60 rotates the diverter in a clockwise direction to a diverting position, which diverting causes a bill or bills to be directed towards the purge transport 68 and the purge bin 70. Those bills which are diverted are those which are detected as being "doubles" instead of being "singles" and those also which are detected as being "too long" or "too short". The "too long" situation occurs when two bills overlap somewhat as a result of improper picking, or as a result of a skewed condition, for example. In some systems, "markers" are placed in the stack of bills within the cassette to mark every hundred bills, for example, so as to facilitate the counting or reconciliation process mentioned earlier. A feature of the system 10 is that individual bills in a stream of bills or the "markers" mentioned can be diverted by the diverter 50. The spacing of bills in the bill delivery system 48 and the response times of the actuator 64 and the spring 60 are such as to enable the diverter 50 to be moved between its non-diverting and diverting positions mentioned to effect such selective diverting. A sensor 71 is used to detect the leading edge of each approaching bill, and its output is used by the controller 42 to let actuator 64 remain de-energized (to purge) and to energize actuator 64 to permit a bill to pass the diverter 50. When diverted, the bills are moved within the bill delivery system 48-1 between the diverter 50 and the purge transport 68. The bill delivery system 48-1 is similar to system 48 already described, and it utilizes drive rollers 72 and 74 which are operatively coupled to the main driving motor 56 as previously described.

Those bills which pass the diverter 50 on the way to the stacking wheel 62 in FIG. 3 are single bills. These bills are moved in the bill delivery system 48-2 by drive rollers 76 and 78 and their associated back-up rollers 79 and 81. The drive rollers 76 and 78 are coupled to the motor 56 as previously described. The approach angle of the bill delivery system 48-2 relative to the stacker wheel 62 is such as to direct a bill 80 between adjacent tines 82 and 84 of the stacker wheel 62. The stacker wheel 62 is rotated in a clockwise direction (as viewed in FIG. 3) about its axis 86 by conventional coupling means (such as a timing belt (not shown)) which is coupled to the drive motor 56. The spacing of the cassettes #1–#5 and the bill delivery systems 48 and 48-2 are designed to enable a bill picked from any one of the cassettes #1–#5 to approach the stacker wheel 62 between two adjacent tines, like 82 and 84. In the embodiment described, the bills are transported in the bill delivery systems 48 and 48-2 at a nominal rate of 46 inches per second, although this rate could be changed for different applications.

As the bills 80 (FIG. 3) are fed into the stacker wheel 62, they are rotated in a clockwise direction (as viewed in FIG. 3) until they are stripped from the stacker wheel 62 by a fork-like, stripper plate 88 which is pivotally mounted on a shaft 90. The stripper plate 88 is biased into the position shown in solid outline by a tension spring (not shown), and the stripper plate 88 is moved to the position shown in dashed outline 88' by an actuator 92 under the control of the controller 42. In a routine dispensing operation, the bills 80 are stripped from the stacker wheel 62 and formed into a stack 94 on a ledge 96 of a carriage designated generally as 98. It is understood that the dispenser 12 may be called upon to dispense a single bill; however, for ease of discussion, the "stack" 94 of bills will be referred to as having several bills. As the bills 80 are fed into the stacker wheel 62, the bills 80 pass an exit sensor 100 whose output is fed into the controller 42 which determines when the entire sum of currency to be dispensed is collected at the carriage 98. During the time that the bills 80 pass the exit sensor 100, it has already been determined that the bills 80 are "single" bills. When the controller 42 determines that the correct amount of bills 80 is collected at the carriage 98, the controller 42 energizes an actuator 102 (such as a reversible motor, for example) which pivots the packer arm 104 (about pin 106) in a counterclockwise direction (FIG. 3) to resiliently bias or squeeze the stack 94 of bills against the carriage 98. Thereafter, the stripper plate 88 is moved to the position shown in dashed outline 88' by the actuator 92 (under the control of the controller 42) to permit the carriage 98 with the stack 94 of bills thereon to be moved towards the left or right teller station depending upon which teller requested the bills or currency.

Figure 3:
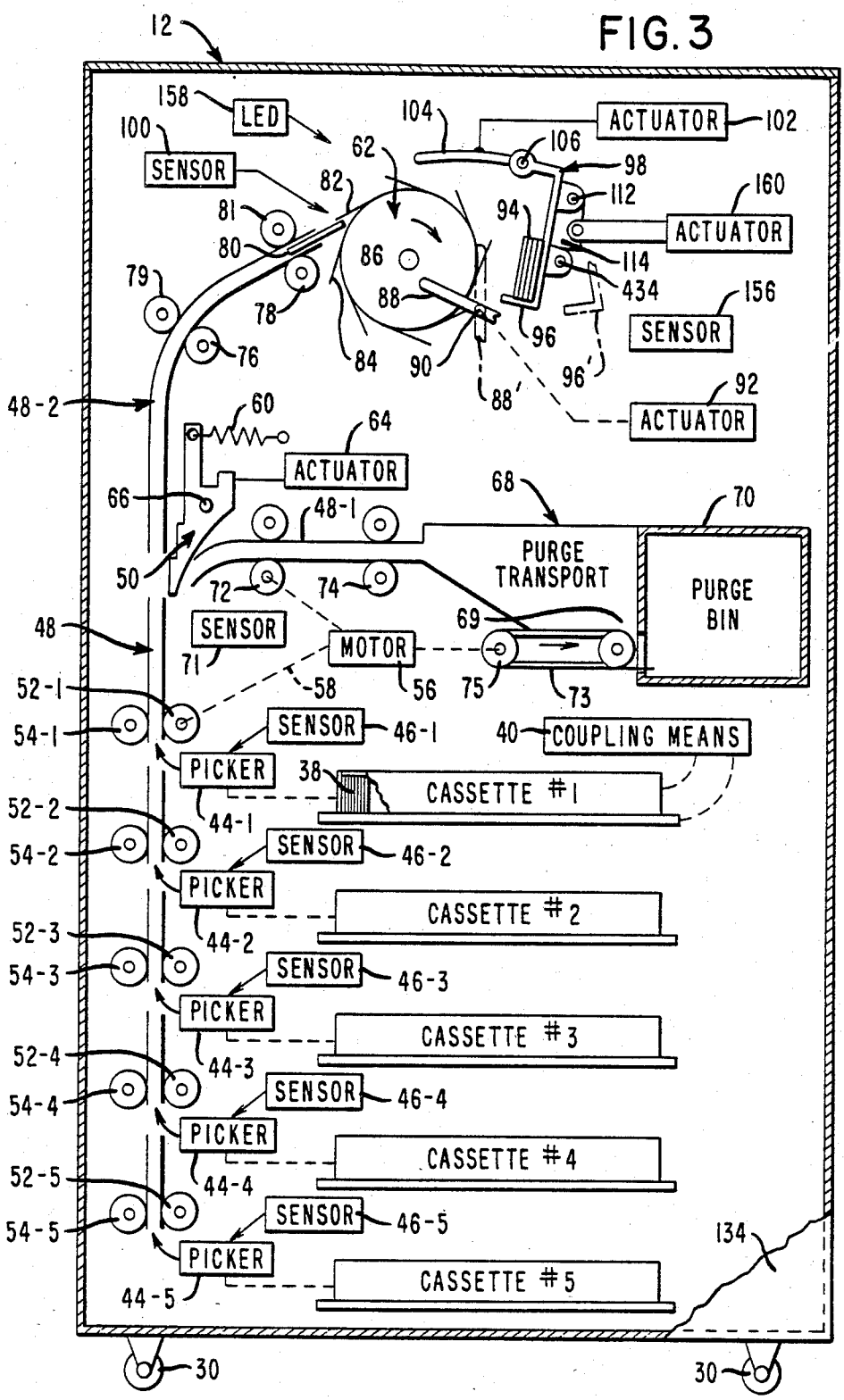
FIG. 3 is a schematic diagram, showing a side elevational view of the cash dispenser, and the view is taken from the direction of arrow A in FIG. 1.
Figure 4:
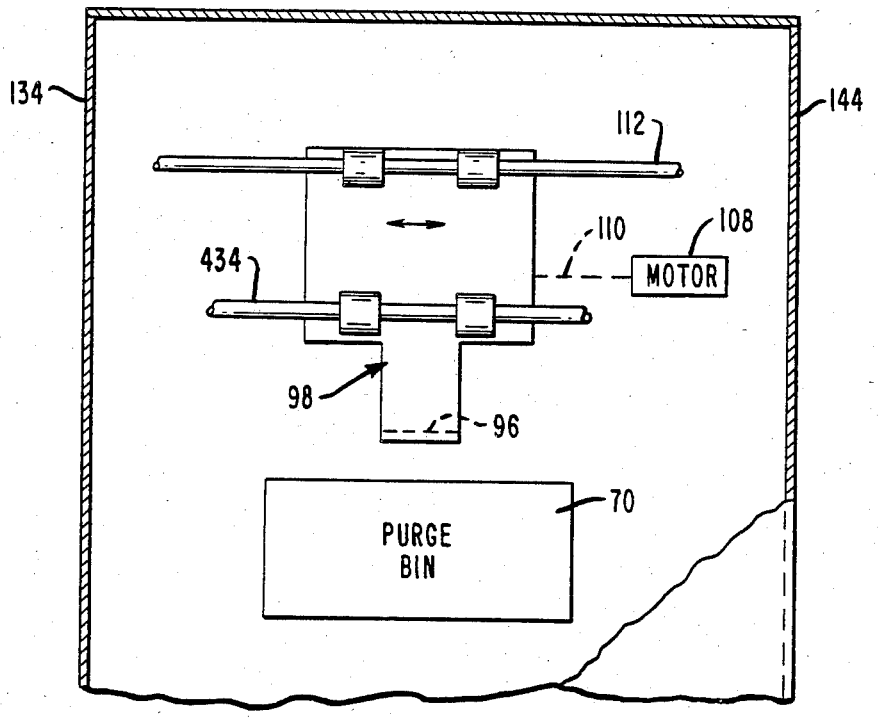
FIG. 4 is a schematic diagram, showing a front, elevational view of the cash dispenser, and the view is taken from the direction of arrow B in FIG. 1.

To move the carriage 98 to the left or right from the home position shown in FIG. 4, a reversible motor 108, under the control of the controller 42, is utilized. The motor 108 is operatively coupled to the carriage 98 by linkage consisting of belts and pulleys, for example, with the linkage being shown as dashed line 110. The carriage 98 is slidably mounted on rods 112 and 434 which are part of a carriage support structure 114 shown schematically in FIG. 3.

Figure 5:
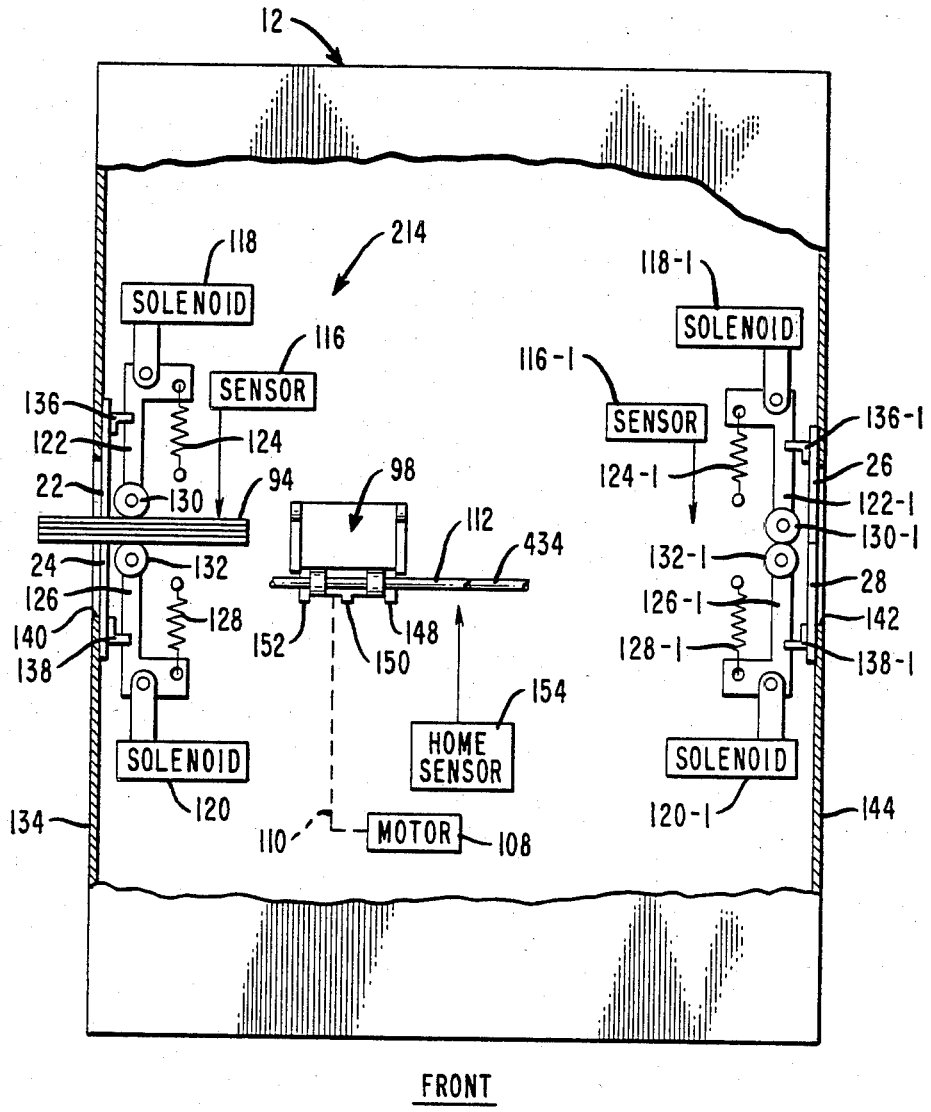
FIG. 5 is a schematic diagram, showing the top, plan view of the cash dispenser with certain portions thereof removed to facilitate the showing.

In the example being described, assume that the carriage 98 is to be moved to the left, as viewed in FIG. 5, so as to present the stack 94 of bills to the left teller station shown in FIG. 1. As the carriage 98 is moved to the left, the leading edge of the stack of bills on the carriage 98 encounters a position sensor 116 whose output indicates this fact to the controller 42. The output from the sensor 116 is also used by the controller 42 to actuate simultaneously, the solenoids 118 and 120. When the solenoid 118 is energized, it pulls the reciprocatingly-mounted arm 122 towards the top of FIG. 5 against the bias of tension spring 124. Correspondingly, when the solenoid 120 is energized, it pulls the reciprocatingly-mounted arm 126 towards the bottom of FIG. 5 against the bias of tension spring 128. The arm 122 has a high-friction roller 130 rotatably mounted thereon as shown, and similarly, the arm 126 has a high-friction roller 132 rotatably mounted thereon as shown. The mounting of each roller 130 and 132 includes a conventional "one-way" clutch (not shown) which permits each of the rollers 130 and 132 to rotate only in a direction which permits the stack 94 of bills to be pulled to the left as viewed in FIG. 5.

At the same time that the arms 122 and 126 are pulled away from each other as just described in relation to FIG. 5, the doors 22 and 24 are opened to permit the stack 94 of bills to extend out of the side panel 134 of the dispenser 12. In this regard, the doors 22 and 24 are secured to their respective arms 122 and 126 by associated connecting bars 136 and 138. The doors 22 and 24 are reciprocatingly mounted in the dispenser 12 and normally close the opening 140 in side panel 134 just as the doors 26 and 28 close the opening 142 in side panel 144. To summarize, as the carriage 98 is moved to the left in FIG. 5 in the example being described, the output of sensor 116 is used by the controller 42 to energize the solenoids 118 and 120 to move the rollers 130 and 132 away from each other and to open the doors 22 and 24.

Figure 2:
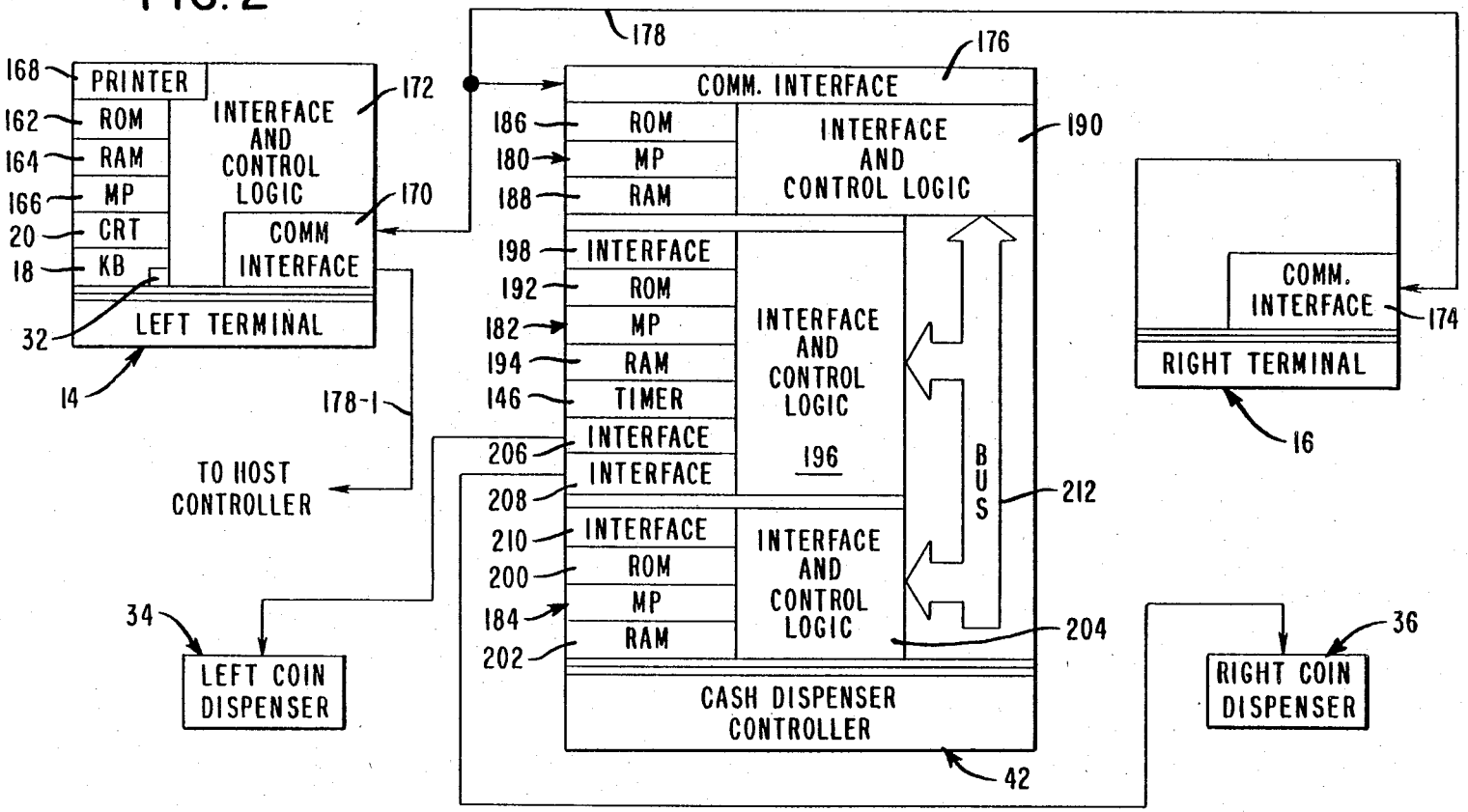
FIG. 2 is a general schematic view, in block form of the system shown in FIG. 1 and it is used to show a cash dispenser controller associated with the cash dispenser and the coupling of the controller with the left and right terminals.

The output of the sensor 116 is also used to initiate the start of a timing period via the timer 146 shown in FIG. 2. At the end of the timing period, the controller 42 de-energizes the motor 108, permitting the carriage 98 to position the leading edge of the stack 94 of bills where it can be grasped by the teller at the left teller station. Also, at the end of the timing period, the solenoids 118 and 120 are de-energized, permitting the tension springs 124 and 128 to pull the associated arms 122 and 126 towards each other. This action causes the rollers 130 and 132 to compress and retain the stack 94 of bills therebetween.

After the rollers 130 and 132 compress the stack 94 of bills between them, the controller 42 energizes the motor 108 for opposite rotation to move the carriage 98 towards the center of the dispenser 12. At this time, the packer arm 104 (FIG. 3) still resiliently compresses the stack 94 of bills; however, because of the now-clamping, high-friction rollers 130 and 132 and their associated one-way clutches mentioned, the carriage 98 can be moved towards the center of the dispenser 12 while the stack 94 of bills is retained between the rollers 130 and 132. This feature enables the carriage 98 to be moved to the home position in the center of the dispenser 12 to ready the dispenser 12 for a currency demand which may be requested of the dispenser 12 by a teller at the right teller station.

In moving towards the home position in the center of the dispenser 12, the carriage 98 has lugs 148, 150, and 152 thereon which coact with a home sensor 154 (FIG. 5) in the following manner. As the carriage 98 moves towards the center of the dispenser 12 from the left side thereof, the lug 148 first coacts with the home sensor 154 to produce a signal to the controller 42 which then decelerates the motor 108 to drive the carriage 98 at a slower speed. When the middle lug 150 reaches the home sensor 154, the associated output is used to stop the motor 108, thereby positioning the carriage 98 at the home position. The signal associated with the middle lug 150 is also used by the controller 42 to energize the actuator 102 (FIG. 3) to raise the packer arm 104 to the position shown in FIG. 3. At this time, the sensor 156 (FIG. 3) is examined by the controller 42 to determine whether or not any bills remain in the carriage 98. A light emitting diode (LED) 158 whose output of light is directed at the sensor 156 will be blocked if bills still exist in the carriage 98. If the light to the sensor 156 is blocked, the controller 42 energizes the actuator 160. The actuator 160 is operatively coupled to the carriage support structure 114, and when the actuator 160 is energized, it rotates the carriage 98 in counter-clockwise direction (FIG. 3) about the rod 112 to a purge position in which the ledge 96 is shown in dashed outline 96'. At the same time, the controller 42 energizes the actuator 92 to move the stripper plate 88 to the position shown in dashed outline 88', permitting any bills in the carriage 98 to be dropped into the purge transport 68. The controller 42 "jogs" or momentarily energizes the actuators 160 and 92 until the sensor 156 indicates that the carriage 98 is clear of bills. The purge transport 68 includes a receptacle 69 which directs the purged bills on to a conveyor belt 73 which is driven by a driving pulley 75 which is operatively coupled to the motor 56. The conveyor belt 73 moves the purged bills to the purge bin 70. Upon receiving a "clear" signal from the sensor 156, the controller 42 causes the stripper plate 88 and the carriage 98 to be returned to the home position shown in solid outline in FIG. 3 to ready the dispenser 12 for another dispensing function.

The right side of the dispenser 12 (FIG. 5) has counterparts which are identical to those explained in describing the transfer of a stack 94 of bills to the left teller station, and these counterparts operate in the same manner as already described. These counterparts are given "dash one" (−1) designations in addition to their basic numbers to identify them and their functions. These counterparts include: the sensor 116-1 (similar to sensor 116); the solenoids 118-1 and 120-1; the tension springs 124-1 and 128-1; the arms 122-1 and 126-1, the connecting bars 136-1 and 138-1; and the rollers 130-1 and 132-1. When the carriage 98 returns towards the home position from the right side of the dispenser 12 (FIG. 5), the lug 152 on the carriage 98 is the first one to coact with the home sensor 154 to decelerate the carriage when approaching the home position. The center lug 150 is then used to stop the carriage 98 as previously described.

Having described the physical components in the dispenser 12, it seems appropriate to discuss the controller 42 (shown in FIG. 2) and the left and right terminals 14 and 16. As previously stated, the terminals 14 and 16 are conventional terminals and are used with regard to the dispenser 12 to request the amount of cash to be dispensed.

The left terminal 14 (FIG. 2) includes, in addition to what has been described already, a read only memory (ROM) 162, a random access memory (RAM) 164, a processor (MP) 166, a printer 168, a communication interface 170, and interface and control logic 172 to enable the terminal 14 to function as what is conventionally considered an "intelligent terminal". The right terminal 16 is the same as the left terminal 14; however, only the communication interface 174 is shown so as to show how the terminals 14 and 16 and the controller 42 are coupled. In this regard, the controller 42 has a similar communication interface 176 which enables the terminals 14 and 16 and the controller 42 to be connected by a conventional data link 178. The communication interface 170 performs routing activities, and in a typical set-up, this interface 170 is used to decide which of the two terminals 14 and 16 gains access to the dispenser 12; this access or priority is done generally on a first-come, first-serve basis. In those situations in which the dispenser 12 is operated by customer-operated terminals like ATMs, the ATMs would be coupled by another data link 178-1 to a host controller (not shown) for the usual customer-identification procedures, account information, etc.

With regard to terminal 14 (FIG. 2), its operation is as follows. The ROM 162 is used, basically, to handle the transactions within the terminal. At the time that the terminal 14 is initialized, its associated programs or routines are loaded into the RAM 164 via a conventional loading device such as a digital-tape, input device (not shown). After the programs and routines are loaded into the terminal 14, the following housekeeping activities are performed:

1. The terminal 14 is identified as the left terminal so as to indicate to the dispenser 12 (via a communication packet) to which side (left or right) the currency is to be delivered.

2. The teller enters his or her identification number into terminal 14.

3. The various sensors 46-1 to 46-5 associated with the cassettes #1–#5 are checked as these are opacitytype detectors which are used in detecting "doubles" which might be picked; and 4. The coupling means 40 (FIG. 3) are read for each one of the cassettes #1–#5. It should be recalled that the coupling means 40 identifies each cassette as to the denomination of the bills in the cassettes, whether or not a sufficient number of bills exists in each cassette to begin cash dispensing operations, and whether or not each cassette is properly positioned in the dispenser 12. Because of the coupling means 40 previously described, the cassettes can be loaded in positions within the dispenser which are different from their normal positions.

In the embodiment described, the cassettes #1–#5, when filled with U.S.A. currency, may contain $1, $5, $10, $20, and $50 bills, respectively. Each bank may determine its own mix of bills to be dispensed in response to a request for a given total value or sum. For example, some banks may require that the sum to be dispensed be comprised of the minimum number of bills of different denominations which will satisfy that sum. Other banks may require that all sums up to $350, for example, be comprised of bills which do not include $50 bills, and for sums above $350, the $50 bills may be used. Generally, a software routine located in the RAM 164, for example, of the terminal 14, is tailored, where necessary, to indicate how the requested sum to be dispensed is to be comprised by the dispenser 12.

The various sums requested by the terminal 14 (FIG. 2), for example, are printed by the printer 168 which is both a receipt or journal printer and a check validation printer. Each terminal 14 and 16 has its own transaction talleys which list the operations which were performed by that terminal.

At this point, it appears appropriate to discuss the various elements included in the controller 42. While the controller 42 may take several forms depending upon a specific processor or processors used, the controller 42, which controls the various elements of the dispenser 12, is divided to provide three general functions. A first processor (MP) 180 is used to handle communications with the terminals 14 and 16. A second processor (MP) 182 is used as a master processor for the dispenser 12. And finally, a third processor (MP) 184 is used to control the various picking activities, for example, associated with the cassettes #1–#5.

Each of the processors 180, 182, and 184 (FIG. 2) has its own ROM and RAM associated therewith. Processor 180 has a ROM 186, RAM 188, and interface and control logic 190 associated therewith as shown. Similarly, the second or master processor 182 has a ROM 192, RAM 194, and interface and control logic 196 associated therewith. Also, the processor 182 has the timer 146 alluded to earlier herein, and it also has a plurality of interfaces shown collectively as interplurality face 198, which interface 198 is used to couple various elements of the dispenser 12 with the controller 42. The processor 182 also has interfaces 206 and 208 which are used to couple the left and right coin dispensers 34 and 36, respectively, to the controller 42. The third processor 184 similarly has a ROM 200, a RAM 202, and interface and control logic 204 associated therewith. The processor 184 also has an interface 210 which is used to couple the controller 42 to certain elements in the dispenser 12. These elements connected to the interface 210 include the coupling means 40 for each of the cassettes #1–#5, the sensors 46-1 to 46-5, and the pickers 44-1 to 44-5. The processors 180, 182, and 184 are coupled to one another via a communications network or a bi-directional bus 212 to enable these processors to communicate with one another. The routines for controlling these processors 180, 182, and 184 are stored in their associated ROMs or RAMs as is typically done.

In a typical transaction, a teller at the left teller station, for example, requests an amount to be dispensed by entering the amount on the keyboard 18 and by depressing the "dispense cash" function key 32 as previously described. The terminal 14 will then translate the cash amount requested (according to the particular scheme of the associated bank) into the number of bills for each denomination required in order to make up the total sum. The required packet of information is sent to the controller 42 via the communication interfaces 170 and 176. The processor 180 in the controller 42 handles the communications as previously described, and routes the required data to processor 184 which controls the picking of bills at the various cassettes #1-#5.

At this point, it should be emphasized that the sensors 46-1 to 46-5 which are associated with the cassettes #1–#5 perform three functions, namely:

1. They check for doubles.
2. They check the length of a bill; and
3. They count for bill presence.

The outputs of sensors 46-1 to 46-5 are routed to the third processor 184 which uses this information to indicate which bills should be diverted. The third processor 184 and the second processor 182 in effect work together to record the number of bills being handled by the dispenser 12. Each of the processors 184 and 182 has counters (not shown) which record the number of bills being processed. The third procesor 184 keeps a count of the number of bills being picked, and the master processor 182 keeps a count of the number of bills passing the exit sensor 100 which is near the entry to the stacker wheel 62. The third processor 184 also keeps tabs on the coupling means 40 (FIG. 3) which provides data as to what denomination of bill is in each cassette, whether or not the cassette has sufficient bills therein, and whether or not the cassette is properly loaded within the dispenser 12. In other words, the third processor 184 handles the processing of bills from the cassettes #1–#5 up to the exit sensor 100 (FIG. 3), and the master processor 182 handles the processing of bills from the exit sensor 100 through dispensing of a stack of bills at the left and right teller stations as previously described.

The master processor 182 also evaluates the transactions and events that have happened in the delivery of bills to the stacker wheel 62 to decide whether or not the stack of bills should be delivered to the tellers or "purged" and dropped into the purge transport 68 to end up in the purge bin 70. The number of bills requested by the controller 14 or 16 (FIG. 2) should equal the number of bills recorded by the exit sensor 100 for a valid transaction. The total number of bills means the total number of bills to be picked from each cassette #1–#5 as determined by the particular software routine used by a bank to determine the matrix of bills of different denominations to make up the total monetary amount to be dispensed.

Having described the operation of the system 10, it appears appropriate to discuss certain improvements which exist in the system 10 shown in FIGS. 1–5.

In this regard, the mechanism designated generally as 214 in FIG. 5, and already described, is referred to as a presenter mechanism; its general function is to present and hold the stack 94 of bills until the teller at the left teller station removes them as previously described.

An improved presenter mechanism designated generally as 216 is shown in FIGS. 6–10. The presenter mechanism 216 is used for the left side of the dispenser 12, and the improved presenter mechanism for the right side of the dispenser 12 is a mirror image of presenter mechanism 216 shown. Consequently, only the presenter mechanism 216 will be shown and described.

The presenter mechanism 216 (FIGS. 6–10) includes a channel member 218 which functions as a frame member and a channel for receiving a stack 94 of bills from the carriage 98. The channel member 218 is secured to the frame of the dispenser 12 by screws 220, shown only in FIG. 8. An "L" -shaped support plate 222 has a flat portion 224 and an offset portion 226 which is spaced from the channel member 218 by spacers 228 (FIG. 6) and fasteners 230. The channel member 218 also has an angled flange 232 and mounting tabs 234 and 236 (FIG. 7) to facilitate mounting the presenter mechanism 216 within the dispenser 12.

The presenter mechanism 216 (FIGS. 6–10) also has a source of light 238 and a detector 240 (FIG. 6) which are positioned on opposed sides of the channel member 218 to detect the leading edge of an approaching stack of bills. The stack of bills 242 (FIG. 6) is shown moving in the direction of arrow 244, which in this figure, is towards the left teller station. When the leading edge of the stack 242 of bills breaks the light to the detector 240, the rollers 130 and 132 (which are the same as those shown in FIG. 5) move away from each other, and the doors 22 and 24 are opened as previously described The light 238 and detector 240 correspond to the sensor 116 shown in FIG. 5.

When the detector 240 indicates that a stack of bills is approaching, the controller 42 energizes the solenoid 246 which is the prime mover for opening the doors 22 and 24 and for moving the rollers 130 and 132 apart. In this regard, the solenoid 246 is secured to the underside of flat portion 224, and the solenoid also includes a compression spring 248, washer 250, and pin 252 which are assembled to bias the plunger 254 of the solenoid 246 in an outward direction relative to the solenoid body.

Figure 6:
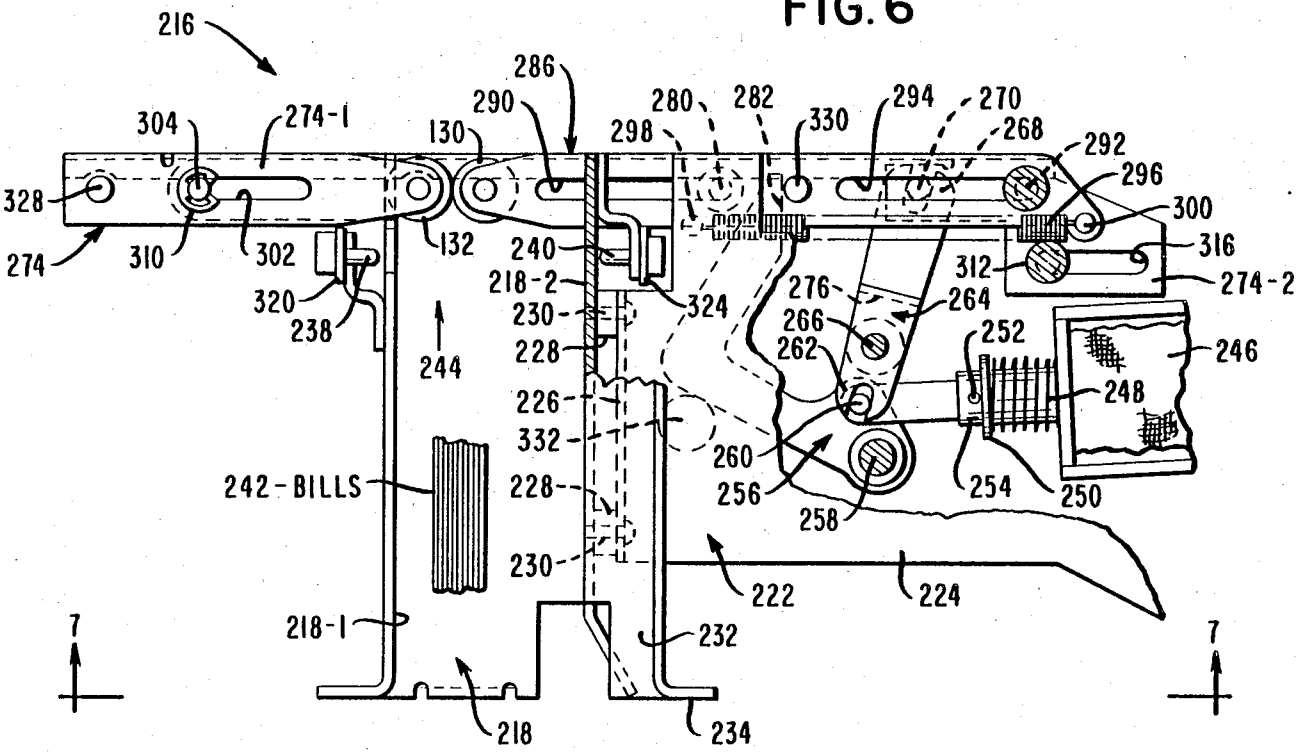
FIG. 6 is a plan view of a brake and door opening mechanism which is used on the left side of the dispenser shown in FIG. 1; the doors are removed in this figure.
Figure 7:
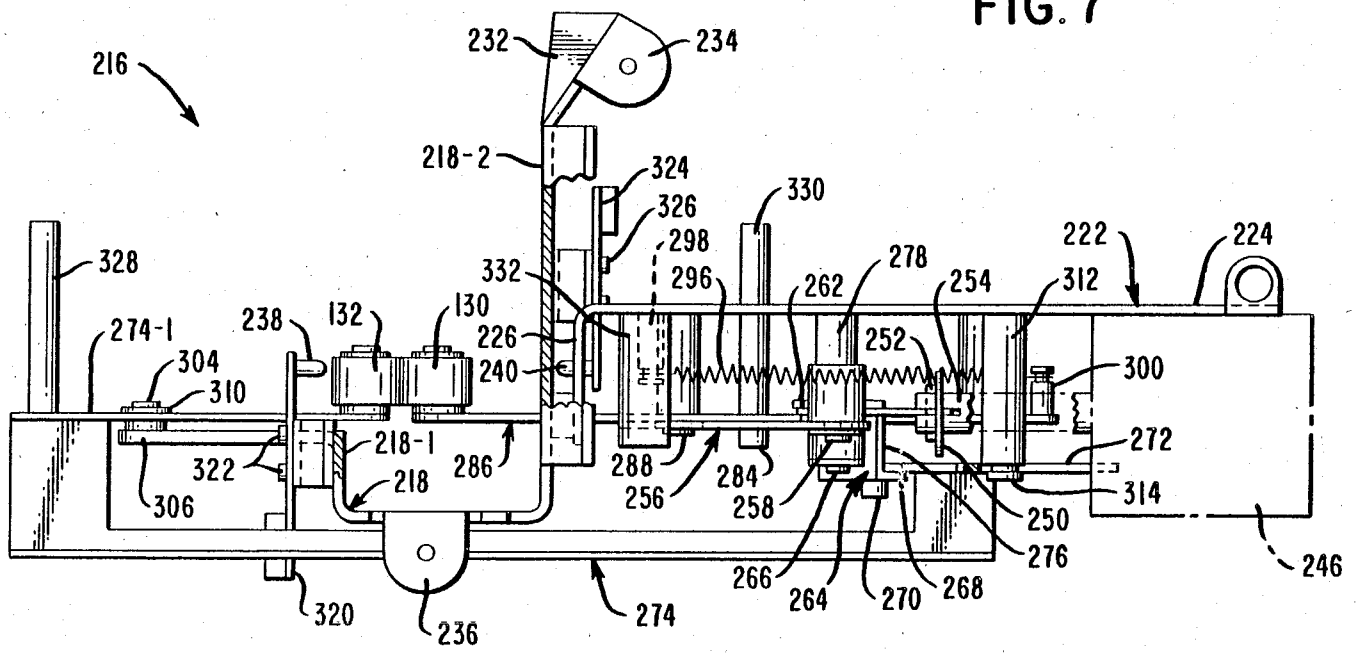
FIG. 7 is an elevational view, taken along the line 7—7 of FIG. 6 to show additional details of the mechanism shown in FIG. 6.
Figure 8:
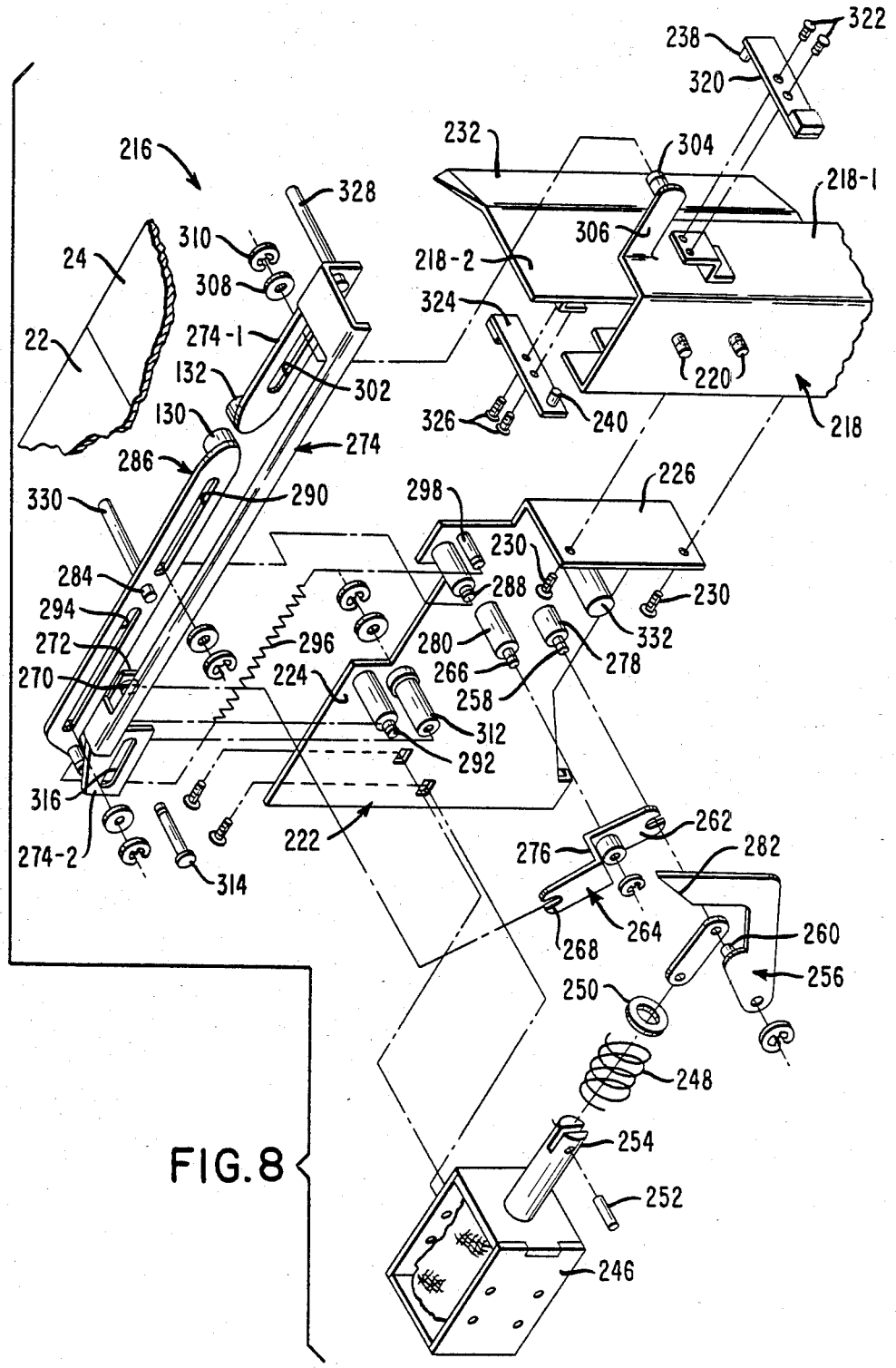
FIG. 8 is an exploded view, in perspective, and it is taken from the general direction of arrow C in FIG. 1 while looking at the underside of the mechanism to show additional details of the mechanism shown in FIGS. 6 and 7.

When the solenoid 246 is energized by the controller 42, its plunger 254 is pulled inwardly, and this plunger movement causes a crank lever 256 to pivot in a clockwise direction (as viewed in FIG. 6) about a pin 258 which extends from the lower side of the flat portion 224 (FIG. 7). The crank lever 256 also has a stud 260 upstanding therefrom and secured thereto as shown best in FIG. 6. The stud 260 is received in a bifurcated end 262 of a lever 264 which is pivotally mounted on a stud 266 which extends from the lower side of the flat portion 224 (FIG. 7). The lever 264 also has a second bifurcated end 268 which receives a stud 270 that is secured to a portion 272 of an arm designated generally as 274. The lever 264 has a joining portion 276 (as seen best in FIG. 8) which joins the bifurcated ends 262 and 268. The crank lever 256 is spaced from the underside of the flat portion 224 (as viewed in FIG. 7) by a spacer 278, and similarly, the lever 264 is spaced from the underside of the flat portion 224 by a spacer 280 (FIG. 8). The crank lever 256 has an end 282 (FIGS. 6 and 8) which engages a stud 284 (FIGS. 7 and 8) extending from the lower side of the arm designated generally as 286. The arm 286 is reciprocatingly mounted on a spacer mounting stud 288 (FIG. 8) which passes through the slot 290, and it is also mounted on a spacer mounting stud 292 (FIG. 8) which passes through the slot 294 (FIGS. 6, 8). The arm 286 is biased towards roller 132 (FIG. 6) by a tension spring 296 which has one end thereof secured to a stud 298 (FIG. 7) that is secured to the underside of flat portion 224 (FIGS. 6, 8) and the remaining end thereof secured to a stud 300 (FIGS. 6, 7) upstanding from one end of arm 286.

The arm 274 (FIGS. 6, 8) has a portion 274-1 having an elongated slot 302 therein which receives a stud 304 which is upstanding from an extension 306 (FIG. 7) that is part of the channel member 218. A suitable washer 308 and "C" clip 310 (FIG. 8) are used to retain the arm portion 274-1 on the extension 304 as is conventionally done. The other end 274-2 of the arm 274 is reciprocatingly mounted on a spacer-type bushing 312 (FIGS. 7, 8) by a fastener 314 which passes through an elongated slot 316 (FIG. 8) in the end 274-2. The light source 238 is located on a mounting bracket 320, and the bracket is secured to a wall 218-1 of the channel member 218 by fasteners 322. Similarly, the detector 240 is mounted on a bracket 324 which is secured to the side wall 218-2 by fasteners 326. The rod 328 is secured to and is upstanding from the arm 274-1. Similarly, the rod 330 is secured to and is upstanding from the arm 286. The rods 328 and 320 are the prime movers for opening and closing the doors 24 and 22, respectively. This aspect will be discussed hereinafter The post 332 provides a limit stop for the movement (in an outward direction) of the plunger 254 of the solenoid.

Having described the elements of the presenter mechanism 216 shown in FIGS. 6, 7, and 8, it appears appropriate to discuss its functioning. As previously stated, when a stack 242 of bills (FIG. 6) approaches the detector 240 and blocks the light from the light source 238, the controller 42 energizes the solenoid 246. When the solenoid 246 is energized, its plunger 254 (FIG. 6) is pulled inwardly causing the crank arm 256 to pivot in a clockwise direction (as viewed in FIG. 6) about pin 258. This action causes the end 282 of the crank arm 256 to move the reciprocatingly-mounted arm 286 to the right as viewed in FIG. 6. At the same time that crank lever 256 is pivoted in a clockwise direction, the stud 260 on the crank lever 256 pivots the lever 264 in a counterclockwise direction (as viewed in FIG. 6) about stud 266, causing the second bifurcated end 268 of the lever 264 to move to the left (as viewed in FIG. 6), thereby moving the arm 274 to the left. By this action, the roller 130 in arm 286 and the roller 132 on arm 274 move away from each other permitting the stack 242 of bills to move therebetween. The doors 22 and 24 would have been opened at this time as shown in FIG. 1. The controller 42 then de-energizes the motor moving the carriage containing the stack of bills (after the time-out period as previously explained). The controller then de-energizes the solenoid 246, permitting the spring 296 and the spring 248 on the solenoid plunger 254 to bias the rollers 130 and 132 towards each other to compress and grip the stack 242 of bills therebetween as previously explained. This gripping permits the carriage, like 98, to be returned to the home position as previously explained.

Figure 9:
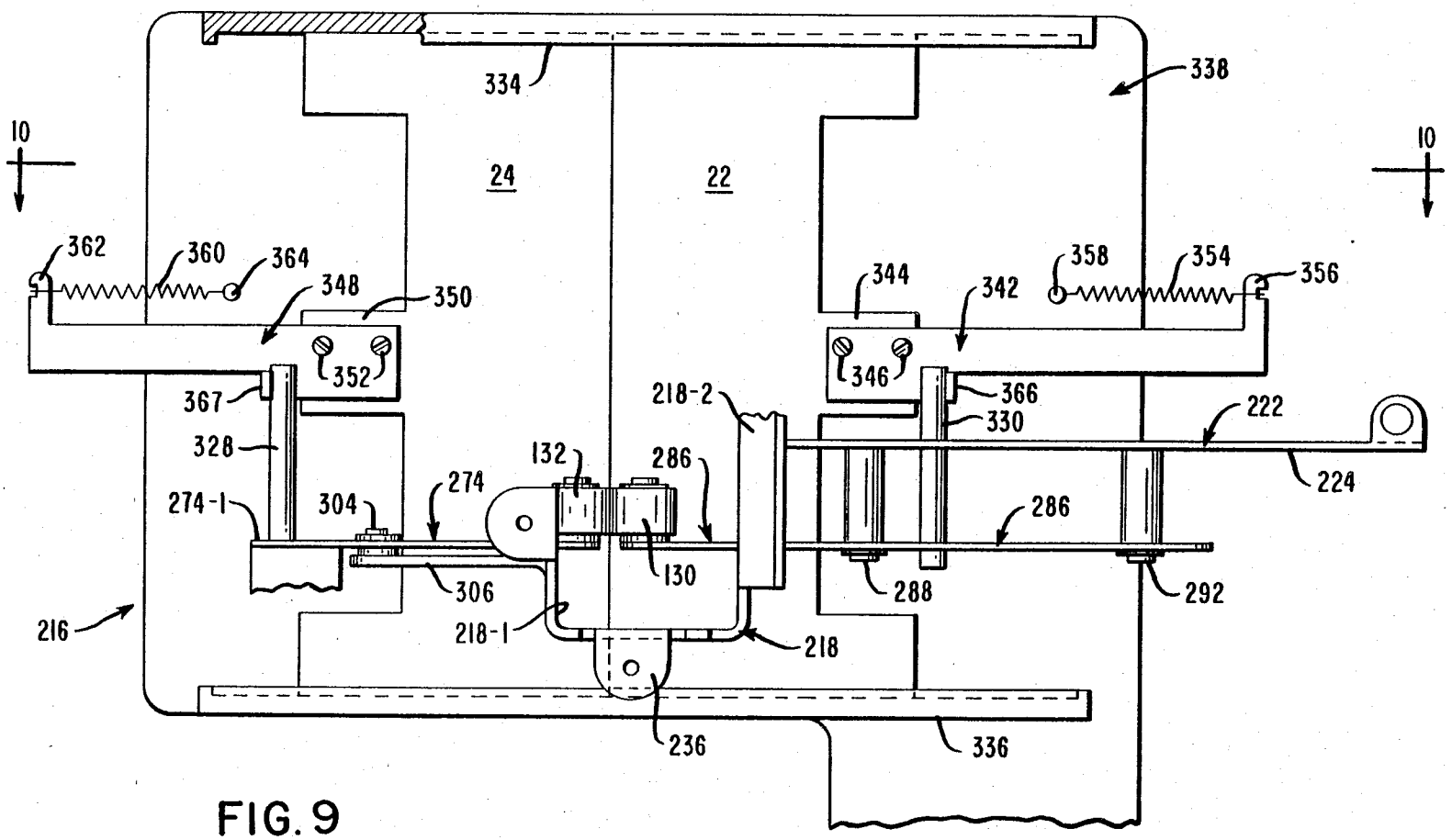
FIG. 9 is a view similar to FIG. 7 showing how the door opening mechanism is coupled to the doors on the left side of the dispenser shown in FIG. 1.
Figure 10:
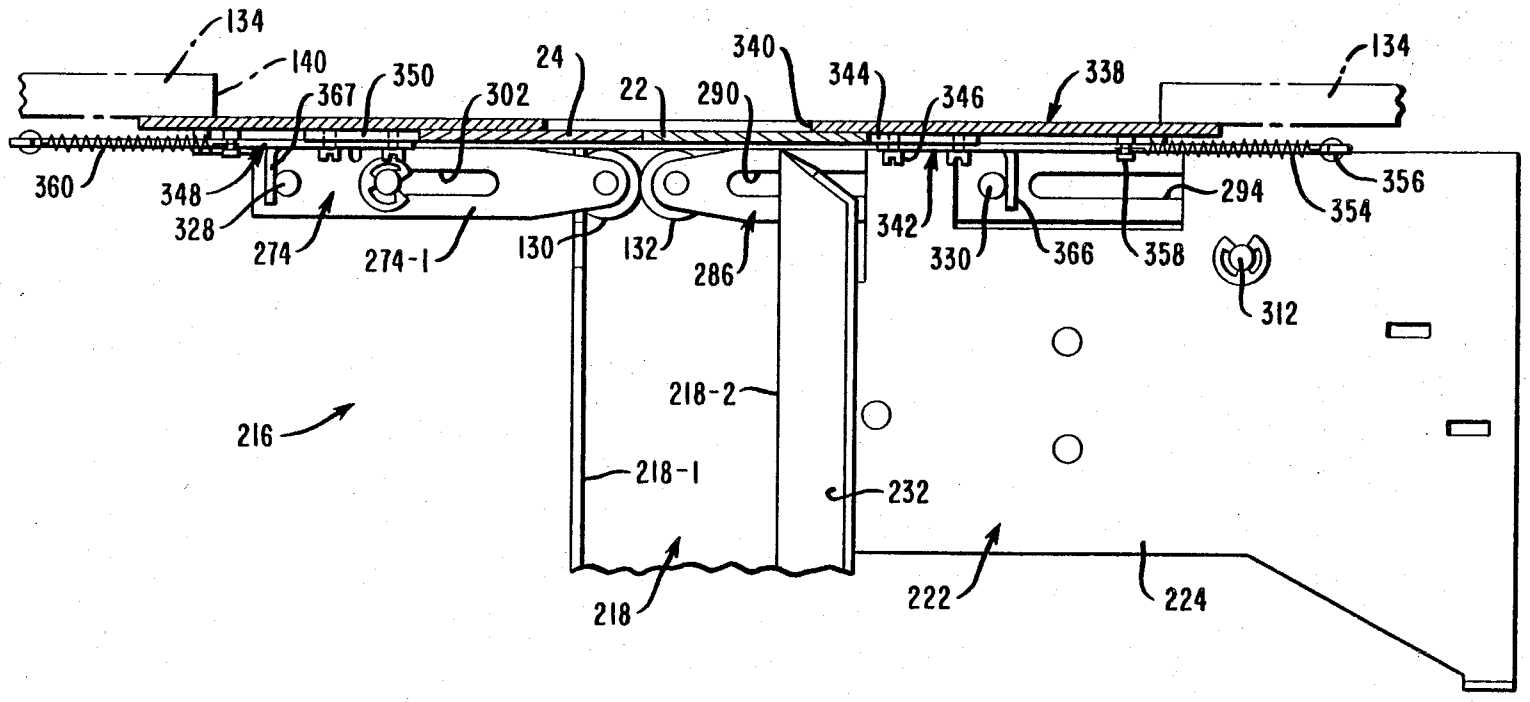
FIG. 10 is a cross-sectional view taken along the line 10—10 of FIG. 9 to show additional details of the mechanism shown in FIG. 9.

As previously mentioned, the doors 22 and 24 move apart from each other when the rollers 130 and 132 are moved apart from each other. FIGS. 9 and 10 show an improved construction of the door opening mechanism shown in FIG. 5.

The doors 22 and 24 are slidably and reciprocatingly mounted in guides 334 and 336 (FIG. 9) which are secured to a panel 338 having an opening 340 (FIG. 10) therein. The panel 338 is positioned next to the opening 140 in the side 134 (shown in phantom outline) of the dispenser 12. The door 24 has the general outline of a number "3" when looking at FIG. 9, and the door 22 has the general outline of a reversed number "3". A bracket 342 is fastened to the center leg 344 of door 22 by fasteners 346. Similarly, a bracket 348 is fastened to the center leg 350 of door 24 by fasteners 352. The door 22 is biased to a closed position by a tension spring 354 that has one end thereof secured to end 356 of bracket 342, with the remaining end of the spring being secured to a stud 358 that is secured to the panel 338. The door 24 is biased, similarly, to a closed position by a tension spring 360 that has one end thereof secured to end 362 of bracket 348, with the remaining end of the spring being secured to a stud 364 that is secured to the panel 338. The bracket 342 has a tang 366 thereon which lies in the path of the rod 330 which reciprocates with the associated arm 286. When the arm 286 is moved away from arm 274, as previously described, the rod 330 moves the tang 366 to the right (as viewed in FIGS. 9, 10), and consequently, the door 22 is opened. When the solenoid 246 (FIG. 6) is released, the arm 286 moves towards arm 274 under the influence of springs 296 and 248. Correspondingly, the door 22 is returned to its closed position by the spring 354. Having the arms 286 and 274 and the associated doors 22 and 24 resiliently brought to a closed position while being positively driven to the open positions avoids injury to operators'-hands during a "closing operation." The bracket 348 associated with door 24 has a tang 366 which cooperates with the rod 328 in the same manner as already described in relation to door 22. The rollers 130 and 132 are positioned closer to the left side of channel member 218 (FIG. 10) than the right side thereof because this is the side of the channel member along which the carriage 98 approaches.

Figure 11:
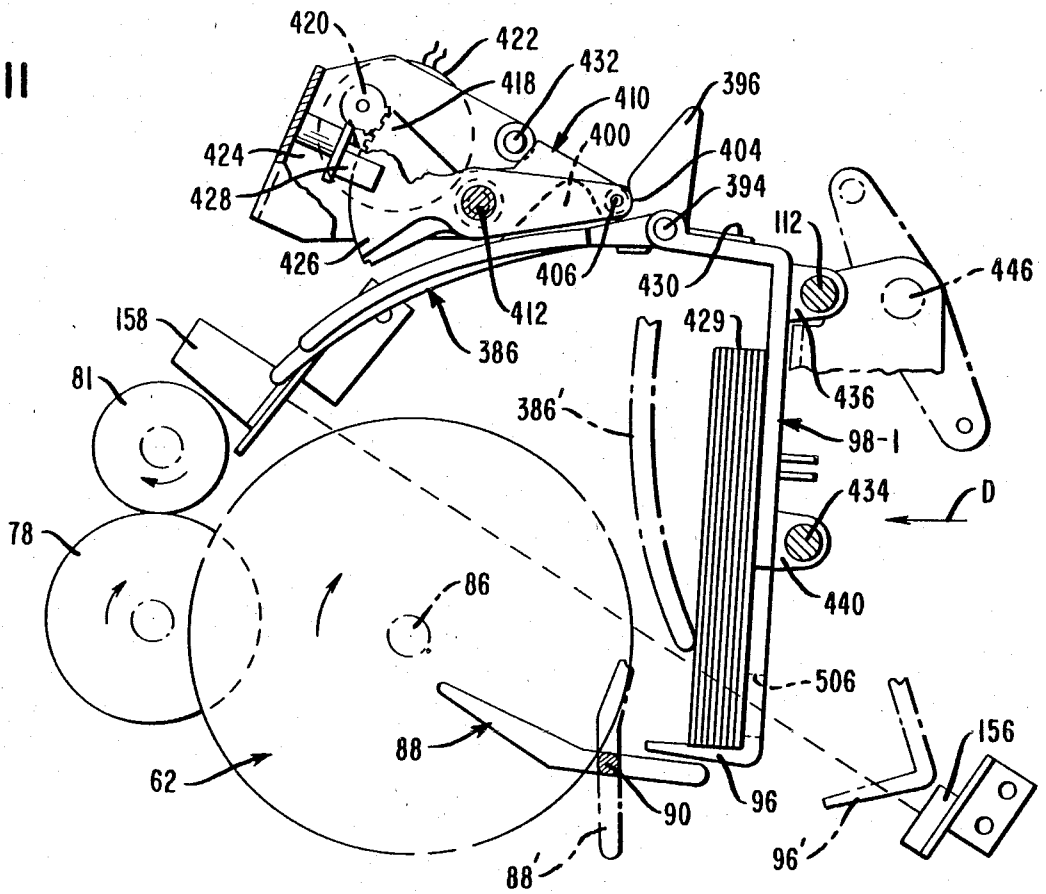
FIG. 11 is a side view, in elevation showing a second embodiment of the packer arm shown in FIG. 3.
Figure 12:
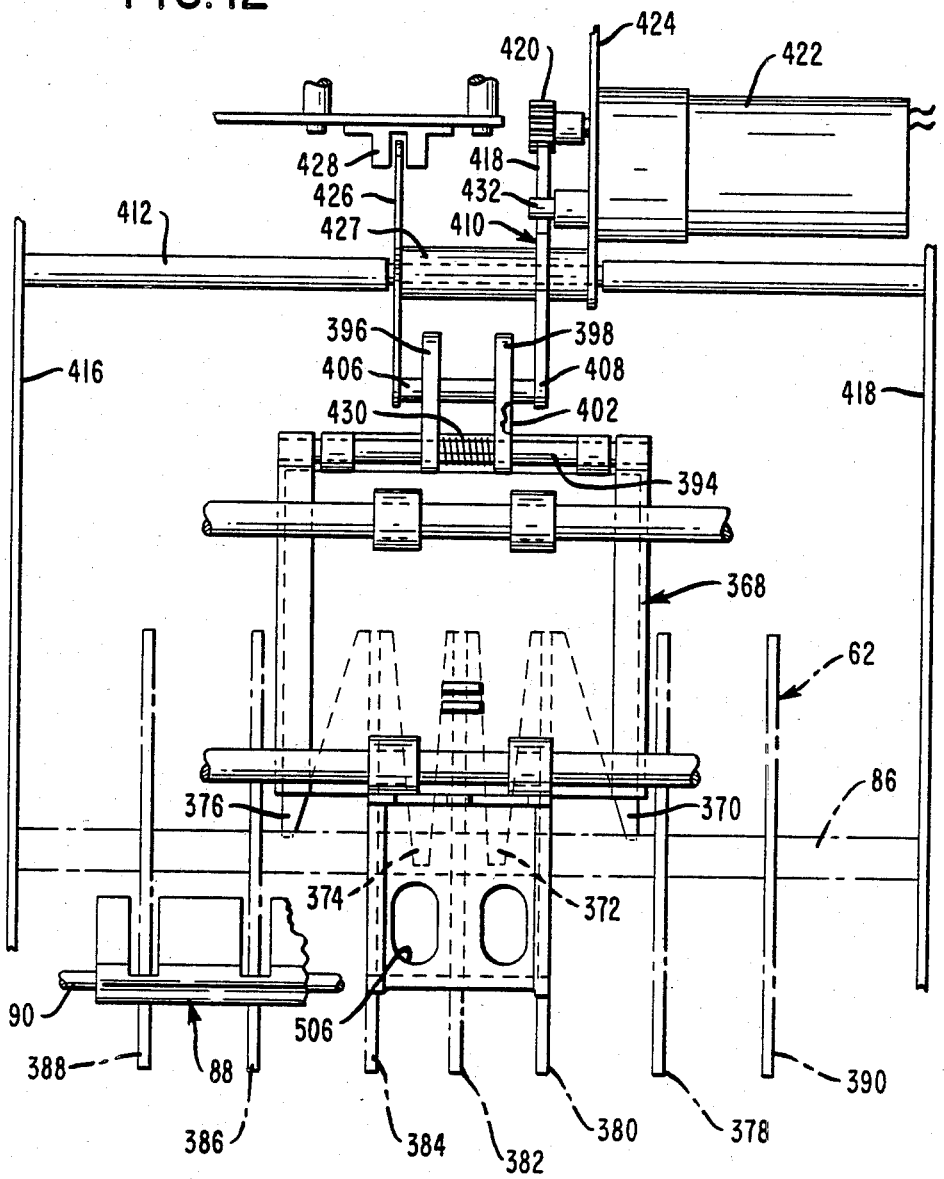
FIG. 12 is an elevational view, taken from the direction of arrow D of FIG. 11, to show additional details of the packer arm.

FIGS. 11 and 12 show another embodiment of a packer arm 368 and a carriage designated generally as 98-1; these correspond in function to the packer arm 104 and the carriage 98 shown in FIG. 3. The packer arm 368 has teeth or tines 370, 372, 374 and 376 which mesh between the tines 378, 380, 382, 384, and 386 of the stacker wheel 62 which also has the outside tines 388 and 390. The packer arm 368 is pivotally supported on a rod 394 which is supported in the carriage 98-1. The packer arm 368 also has a first pair of spaced projections 396 and 398, and a second pair of spaced projections 400 and 402, with the projection 402 being shown only partially behind projection 398 in FIG. 12; these two pairs of projections form a camming recess 404 (FIG. 11) therebetween which receives a camming bar 406. The camming bar 406 is secured to one end 408 of a camming lever 410 which is pivotally mounted between its ends on the rod 412 which is mounted between the frame supports 414 and 416. The remaining end of the camming lever 410 has a sector gear 418 thereon that meshes with a driving pinion 420 of a motor 422 which is under the control of the master processor 182 (FIG. 2). The motor 422 is mounted on a flange 424 which is supported on one end on the rod 412 and the remaining end is secured to an additional support (not shown). A second lever 426, having the same general shape as the camming lever 410, is secured to the camming lever 410 via the bushing 427 (FIG. 12) to pivot with the camming lever 410. The second lever 426 coacts with the position detector 428 whose output is fed into the master processor 182 which uses the output to determine the position of the camming lever 410.

The packer arm 368 is shown in the non-packing position in FIG. 11. After a correct count of bills has been determined by the controller 42 as previously explained, the controller 42 energizes the motor 422 to lower the packer arm 368 to compress the stack 429 of bills on the carriage 98-1. To lower the packer arm 368, the motor 422 is energized to rotate the camming lever 410 in a clockwise direction (as viewed in FIG. 11) about rod 412, causing the camming bar 406 to pivot the packer arm 368 in a counter clockwise direction about rod 394. A torsion spring 430 (FIG. 12) mounted on the rod 394 causes the packer arm 368 to move to the position shown in dashed outline 368' in FIG. 11 to compress the stack 429 of bills against the carriage 98-1. As the camming lever 410 continues to rotate out of the way of the packer arm 368", the output of the detector 428 is used by the controller 42 to stop the motor 422 in such an out-of-the way position. When the packer arm 368 is to be returned to its home position after a successful dispensing of bills, the controller 42 energizes the motor 422 to rotate in the opposite direction. This enables the camming bar 410 to mesh into the recess 404 and to rotate the packer arm 368 to the position shown in solid outline in FIG. 11. The movement of the second lever 426, in cooperation with the position detector 428, informs the controller 42 as to when to de-energize the motor 422. A limit stop 432 secured to the flange 424 limits the movement of the camming lever 410 towards the home position shown in FIG. 11. The remaining elements not discussed in relation to FIGS. 11 and 12 but having reference numerals identical to numerals used in relation to FIGS. 1–5 are similar elements and have similar functions to those already discussed. For example, drive roller 78 and pinch roller 81 feed the bills into the stacker wheel 62.

Figure 13:
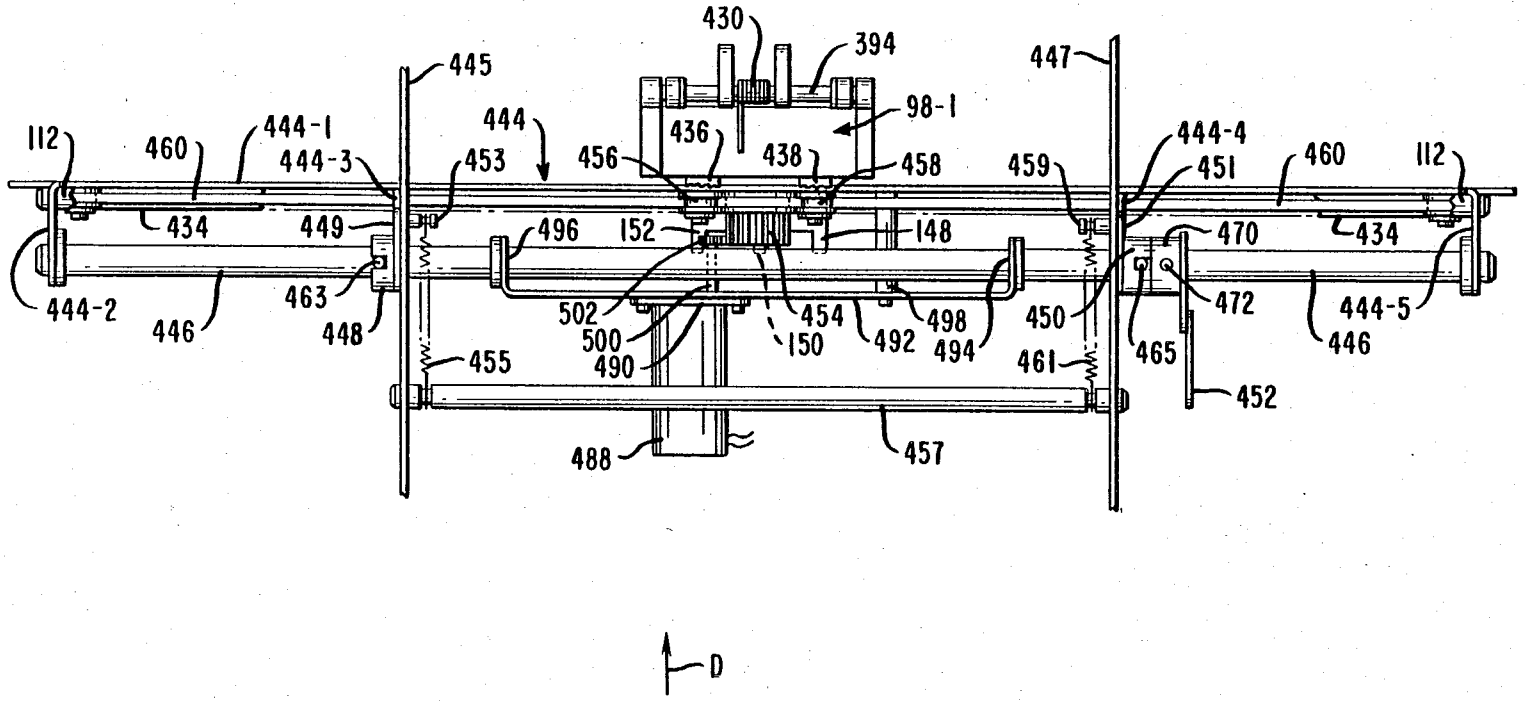
FIG. 13 is a plan view of a second embodiment of the means for moving the carriage to the left and right teller stations; this view is similar to that shown in FIG. 5.
Figure 14:
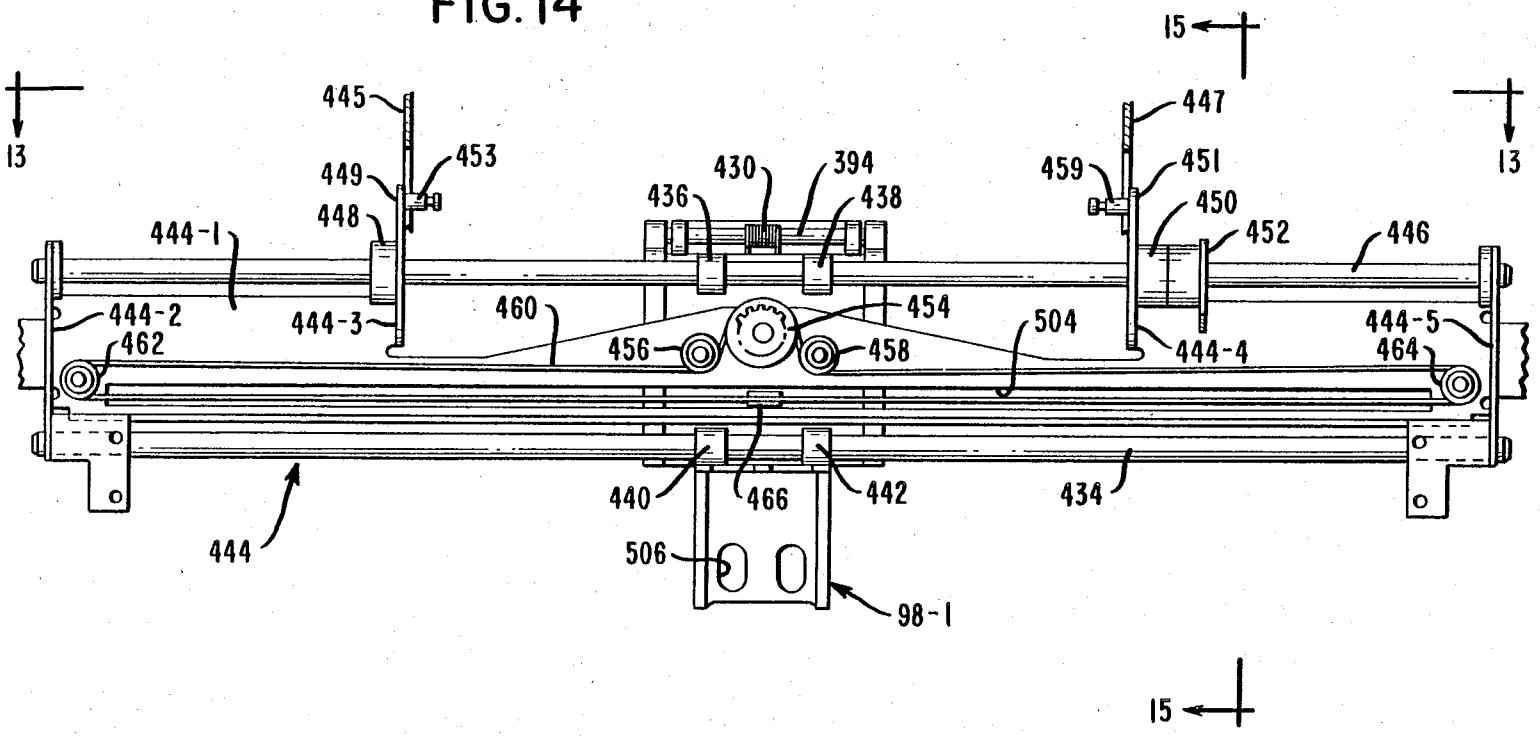
FIG. 14 is an elevational view that is taken from the direction of arrow D in FIG. 13 to show additional details of the means for moving the carriage.
Figures 15, 16:
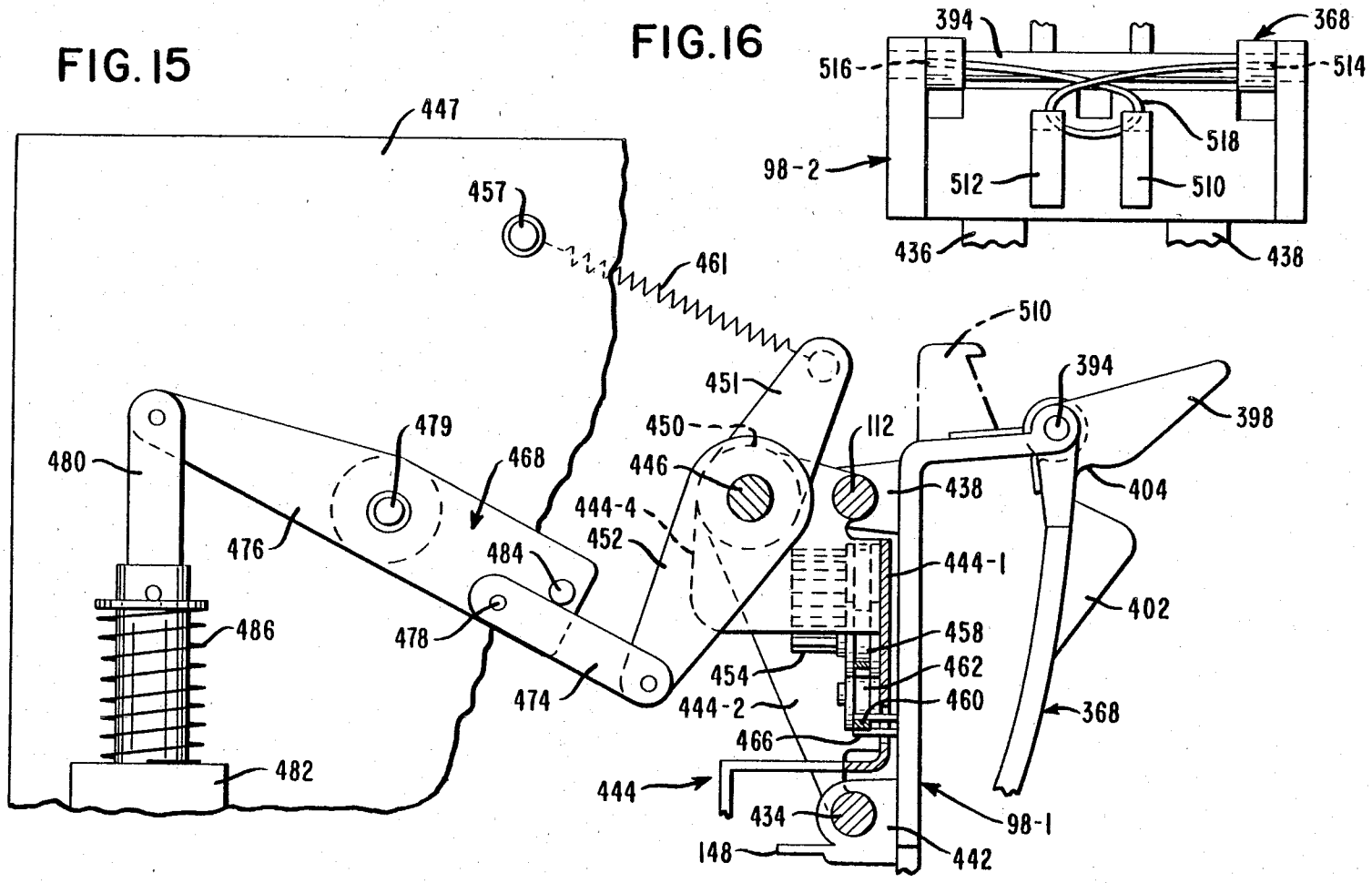
FIG. 15 is an elevational view, partly in cross-section, and is taken along the line 15—15 of FIG. 14.
FIG. 16 is a plan view of another embodiment of the carriage shown in FIG. 15, for example.

FIGS. 13, 14, and 15 show a second embodiment of the means for moving the carriage 98-1 to the left and right teller stations shown in FIG. 1. The carriage 98-1 is slidably supported on rods 112 and 434 by apertured extensions 436, 438, 440, and 442 which extend from the same side of the carriage 98-1 as shown best in FIG. 14. The rods 112 and 434 are supported in a frame member designated generally as 444. The frame member 444 is comprised of a straight portion 444-1 and flange portions 444-2, 444-3, 444-4, and 444-5 which are positioned at right angles to the straight portion 444-1. The rods 112, 434 and 446 are supported in the flange portions 444-2 through 444-5. Additionally, the shaft 446 is rotatably supported in vertically-positioned, side frames 445 and 447 which extend substantially along the entire height of the dispenser 12 to provide the basic frame support structure between which the cassettes #1–#5 are located.

The flange portion 444-3 has a moment arm 449 thereon, and similarly, the flange portion 444-4 has a moment arm 451 thereon as shown best in FIG. 15. The moment arm 449 has a stud 453 secured thereto, and one end of a spring 455 (FIG. 13) is secured to the stud 453, and the remaining end of the spring 455 is secured to a rod 457 which is supported between the side frames 445 and 447. Similarly, the moment arm 451 has a stud 459 secured thereto, and one end of a spring 461 is secured to the stud 459, and the remaining end of the spring 461 is secured to the rod 457. The moment arm 449 has a locking collar 448 (FIG. 13) secured thereto, and the collar 448 is secured to the shaft 446 by a pin 463. Similarly, the moment arm 451 has a locking collar 450 secured thereto, and the collar 450 is secured to the shaft 446 by a pin 465. By this construction, the springs 455 and 461, acting on their associated moment arms 449 and 451, respectively, bias the carriage 98-1 to pivot in a counterclockwise direction (as viewed in FIG. 15) to return the carriage 98-1 to the home position shown in FIG. 15 after a purging operation as previously described The carriage 98-1 is moved to the purging position previously described by the actuator designated generally as 468 and shown best in FIG. 15. The actuator 468 includes an actuating lever 452 having a locking collar 470 (FIG. 13) secured thereto. The locking collar 470 is pinned to the shaft 446 by a locking pin 472. The free end of lever 452 is pivotally joined to one end of a toggle link 474, and the remaining end of the link 474 is pivotally joined to lever 476 by a pin 479. The lever 476 is pivotally supported between its ends on a stud 478 which extends from the side frame 447. The remaining end of lever 476 is pivotally joined to the operating plunger 480 of a solenoid 482 which is secured to the side frame 447. The lever 476 also has a stud 484 extending therefrom, and this stud 484 is biased into engagement with the toggle link 474 by the compression spring 486 mounted on the plunger 480 of the solenoid 482. When the stud 484 engages the toggle link 474 as shown in FIG. 15, it prevents the carriage 98-1 from rotating in a clockwise direction (as viewed in FIG. 15) during the time that the stacker wheel 62 is loading bills on the carriage 98-1. In other words, the toggle link 474 prevents accidental purging.

When the controller 42 wishes to purge a stack of bills as previously described, the controller 42 energizes the solenoid 482 (FIG. 15) which, in turn, pivots the lever 476 in a counterclockwise direction as viewed in FIG. 15. When the lever 476 pivots in a counterclockwise direction, the stud 484 is moved away from the toggle link 474, permitting the lever 452 to be rotated in a clockwise direction relative to the longitudinal axis of shaft 446 to thereby pivot the carriage 98-1 in a clockwise direction (FIG. 15) about the longitudinal axis of shaft 446. This action pivots the carriage 98-1 to the purge position discussed earlier herein. The controller 42 repeatedly and momentarily energizes the solenoid 482 to remove bills from the carriage 98-1 as previously explained.

The means for moving the carriage 98-1 (FIGS. 13, 14, and 15) also includes a pulley 454 which is rotatably supported on the straight portion 444-1 of the frame member 444. The pulley 454 also has a conventional slip clutch (not shown) incorporated therein to prevent the carriage 98-1 from injuring an operator's hand should he attempt to grasp the bills too early. There are two idler pulleys 456 and 458 rotatably mounted on the straight portion 444-1 of the frame member 444; these pulleys keep the endless timing belt 460 in firm contact with the pulley 454. Two additional idler pulleys 462 and 464 are also rotatably mounted on the straight portion 444-1 of the frame member 444 at opposite ends thereof as shown best in FIG. 14. On the back of the carriage 98-1 there is a slotted, toothed anchor 466 into which the toothed timing belt 460 is inserted so as to provide a positive driving connection between the belt 460 and the carriage 98-1. The toothed anchor 466 has teeth therein which mesh with the teeth on the belt 460.

The means for moving the carriage 98-1 to the left and right teller stations also includes the reversible driving motor 488 whose mounting flange 490 is secured to a plate 492. The plate 492 has apertured flanges 494 and 496 which are loosely mounted on the shaft 446. A bushing 498 secured between the plate 492 and the straight portion 444-1 of the frame member 444 provides rigidity for mounting the motor 488 relative to the driving gear 454. The motor 488 has a gear reduction unit therein (not shown) which causes its output shaft 500 to be offset as shown in FIG. 13. The output shaft 500 has a driving gear 502 fixed thereto, and the gear 502 meshes with the gear 454. When the motor 488 is energized in one direction by the controller 42, the carriage 98-1 is moved to the left as viewed in FIG. 13, and when the motor 488 is energized in the opposite direction, the carriage 98-1 is moved to the right. The carriage 98-1 has the lugs 148, 150, and 152 located on the opposite side of the carriage 98-1 from the carriage 98 shown in FIG. 5; however, these lugs coact with the home sensor 154 (FIG. 5) as previously described. A suitable horizontal slot 504 (FIG. 14) located in the straight portion 444-1 of the frame member 444 permits the lugs 148, 150, and 152 to be moved to the left and right with the carriage 98-1. The home sensor 154 shown in FIG. 5 but not shown in FIG. 13 is fixed to the mounting plate 492 to coact with the lugs 148, 150, and 152 as previously described. As the carriage 98-1 is moved to the left and right, the stack 242 of bills therein coacts with the detector 240 as previously described in relation to FIG. 6, for example. When the carriage 98-1 is returned to the home position shown in FIG. 11, light from the light source 158 is directed at the sensor 156 to check for any bills which may have remained on the carriage 98-1. The carriage 98-1 has a suitable aperture like 506 in FIG. 14 to permit the light to pass therethrough.

FIG. 16 shows another embodiment of the carriage which is designated generally as 98-2. The packer arm 368 is pivotally mounted on the rod 394 as previously described. The top of the carriage 98-2 has two planar retainers 510 and 512 thereon as shown. The retainers 510 and 512 are also shown in dashed outline 510' in FIG. 15 just to show their profile; however, the retainers 510 and 512 do not actually appear on the carriage 98-1 shown in FIG. 15. The packer arm 394 has apertures therein into which the ends 514 and 516 of a single-turn, loop spring 518 are inserted as shown in FIG. 16. The loop spring 518 performs the same general function as does the torsion spring 430 already discussed in relation to FIG. 11; however, the performance of the loop spring 518 appears to be better than the torsion spring 430. The loop spring 518 is designed to provide a toggling action to the packer arm 368. The loop of the spring 518 is retained under lips 511 of the planar retainers 510 and 512. In operation, when the camming bar 406 pivots downwardly (as viewed in FIG. 11), the packer arm 368 is moved past a dead center position relative to the carriage 98-1, and thereafter, the loop spring resiliently pivots the packer arm 368 to compress the bills on the carriage 98-1 as previously explained. On the return trip, the camming bar 406 returns the packer arm 360 to and past the dead center position, and thereafter, the loop spring 518 moves it farther out of the way of the stacker wheel 62.

Figure 17:
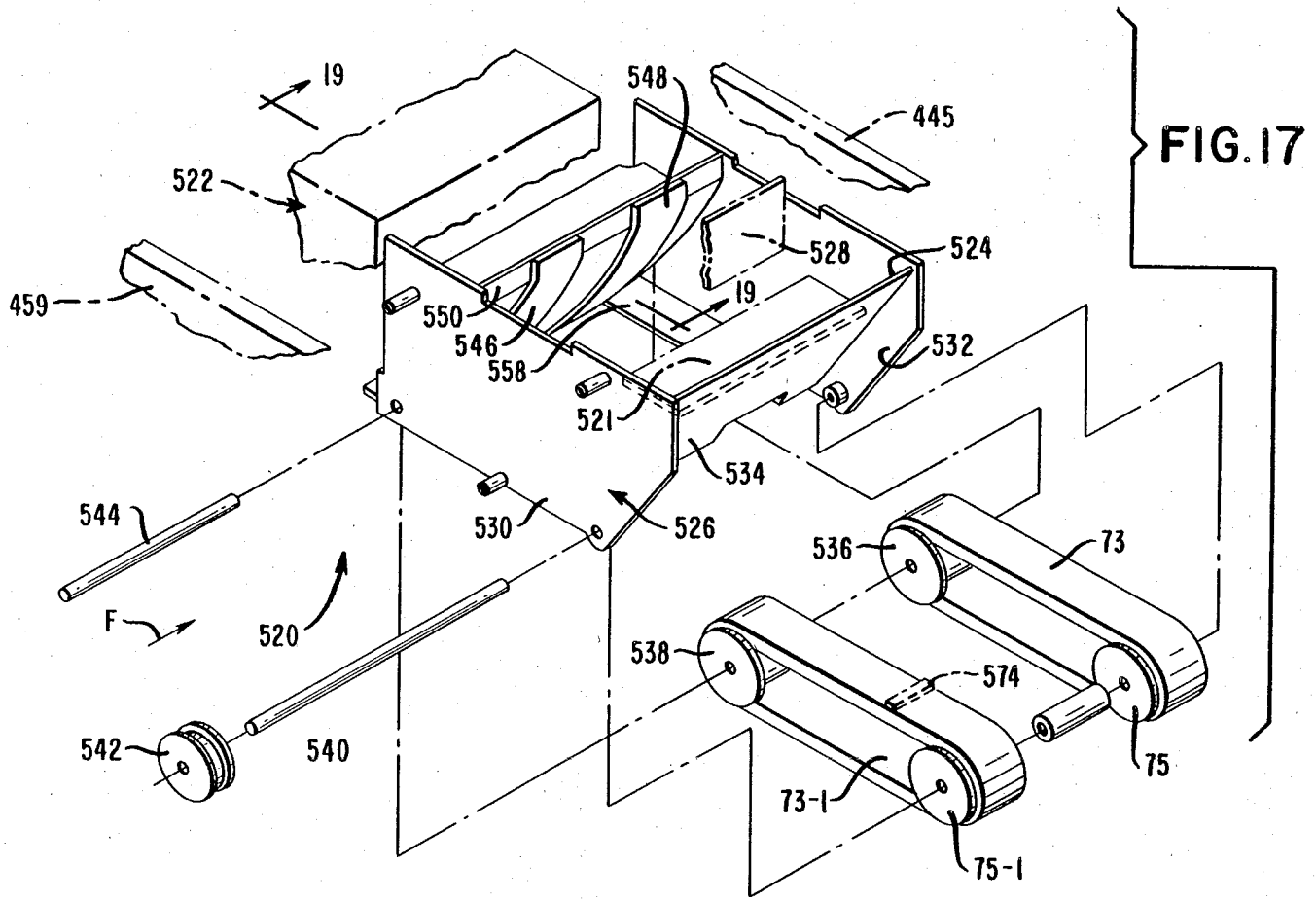
FIG. 17 is an exploded, perspective view taken from the direction of arrow E in FIG. 1 while looking towards the front panel of the dispenser to show another embodiment of the purge transport and purge bin shown in FIG. 1.

FIG. 17 is a perspective view of a second embodiment of the purge transport 69 and purge bin 70 shown in FIG. 3, and this second embodiment is designated generally as 520. The side frames 445 and 459 are shown im phantom outline to orient the reader; they also provide conventional support for the purge bin 522 which is shown only schematically in FIG. 17. The embodiment 520 also includes the purge transport 524. A purged bill 521 from the bill transport system 48-1 (FIG. 3) is shown (in phantom outline) entering over a top lip 524 of the purge transport 526. Correspondingly, a stack of bills being purged from the carriage, like 98 in FIG. 1, is shown in phantom outline as 528.

The purge transport 526 (FIG. 17) has side walls 530 and 532 and a plate 534 positioned at an angle to direct the bills towards the endless conveyor belts 73 and 73-1. Belt 73 is mounted on drive pulley 75 and idler pulley 536. Similarly, conveyor belt 73-1 is mounted on drive pulley 75-1 and idler pulley 538. The drive pulleys 75 and 75-1 are fixed to the shaft 540 to rotate therewith. The shaft 540 is rotated by a pulley 542 which is operatively coupled to the drive motor 56 (FIG. 3) causing the belts 73 and 73-1 to move any bills dropped thereon towards the purge bin 522. The shaft 540 and rod 544 are rotatably supported in the side walls 530 and 532.

Figure 18:
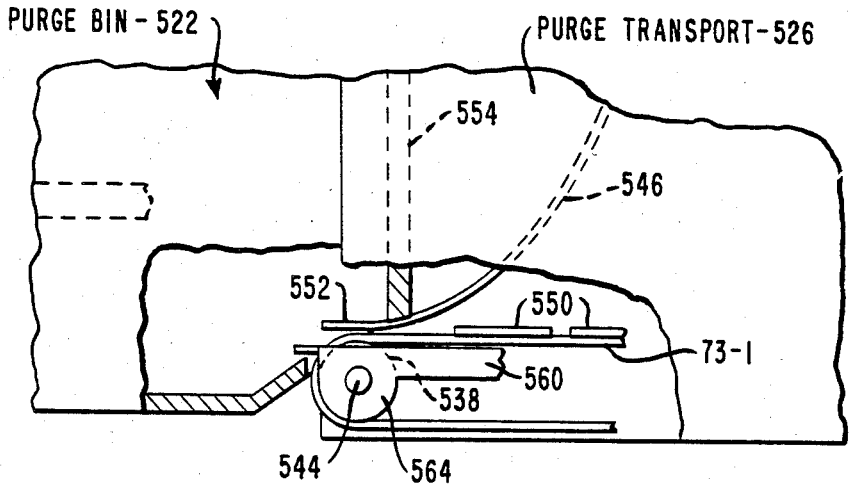
FIG. 18 is a side elevational view of the purge transport and purge bin shown in FIG. 17, with certain portions of the purge transport and bin removed to facilitate a showing of the embodiment.

The purge transport 526 also has a means which facilitates the loading of bills into the purge bin 522; this means includes two spaced, parallel members 546 and 548. Each of these members 546 and 548 has one end thereof which is secured to a cross bar 550 which is secured to the side plates 530 and 532. The shape of the lower end of the member 546 is shown in FIG. 18 to show its relationship to the purge bin 522. The members 546 and 548 are shaped to be biased into engagement with the belts 73-1 and 73, respectively. An approaching bill 550 is forced between the end 552 of member 546 and its associated belt 73-1. Notice that the bills, like 550, are moved into the purge bin 522 near the bottom of the purge bin. Normally, bills are loaded into the top of a purge bin; however, in the present dispenser 12, space considerations required this unusual approach.

Figure 19:
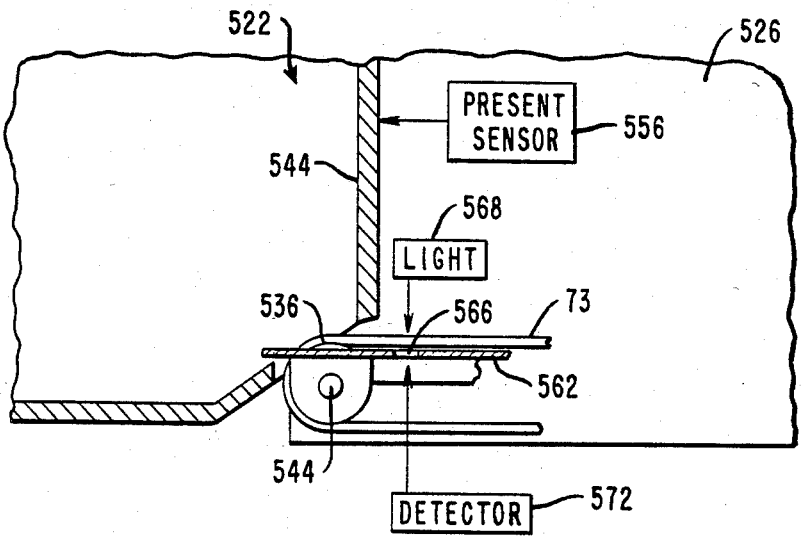
FIG. 19 is a cross-sectional view, taken along the line 19—19 of FIG. 18 to show the location of certain sensors used with the embodiment shown in FIGS. 17 and 18.

FIG. 19 shows the locations of certain sensors associated with the embodiment 520 shown in FIGS. 17 and 18. An end wall 554 of the purge bin 522 coacts with a "present" or feeler sensor 556 whose output is fed to the controller 42 to check that a purge bin 522 has been installed in the dispenser 12 as part of the controller's usual housekeeping functions. The purge transport has two outside support plates 558 (FIG. 17) and 560 (FIG. 18) and a third center support plate 562 (FIG. 19). Plate 560 is supported by a down-turned flange 564 which is supported on the rod 544, and the remaining supports 558 and 562 are similarly supported. The third support plate 562 is positioned between the conveyor belts 73 and 73-1. The center support plate 562 also has a hole 566 therein which permits light from the light source 568 to pass therethrough to the detector 570 when no bills are in the area. The output of the detector 572 is used by the controller 42 to obtain an approximate count of the total number of bills being purged by counting intermittent interruptions in the light to the detector 572. When light to the detector 572 is blocked for a predetermined time, it means that bills are "backing up" on the center plate 562, and that therefore, the bin 522 is "filled"; the controller 42 then stops operations until this condition is corrected. A suitable instruction is given on one of the terminals 14 or 16 (FIG. 1) in this regard. Notice that the detector 572 is outside the purge bin 522. The endless belts 73 and 73-1 may have a plurality of cross bars, like 574 (only one shown) thereon to facilitate the flow of certain sheets, like new bills into the purge bin 522.

What is claimed is:

1. A transport system for use with a sheet dispenser comprising:

means for collecting sheets to be dispensed;

a collecting bin positioned below said collecting means to receive sheets to be purged from said collecting means;

a purge bin having an entrance thereto, with said entrance being located near the bottom of said purge bin;

an endless belt means positioned at the bottom of said collecting bin to receive said sheets to be purged, with said endless belt means having a discharge end;

said endless belt means and said entrance to said purge bin being positioned so that said discharge end is positioned adjacent to said entrance;

means for moving said endless belt means in a direction which moves the sheets carried by said endless belt means into said entrance area; and bias means to resiliently bias said sheets against said discharge end of said endless belt means to facilitate the moving of said sheets into said entrance of said purge bin.

2. The transport system as claimed in claim 1 in which said bias means comprises:

a first member having first and second ends;

a second member having first and second ends;

a cross bar mounted in said collecting bin;

said first ends of said first and second members being secured to said cross bar in spaced parallel relationship thereon with said second ends resiliently biasing said sheets against said discharge end of said endless belt means.

3. The transport system as claimed in claim 2 in which said endless belt means comprises:

first and second endless belts, and at least one support plate positioned between said first and second endless belts to facilitate the flow of sheets from said endless belt means to said entrance.

4. The transport system as claimed in claim 3 in which said support plate has a hole therein and in which said collecting bin includes a light source and a detector positioned on opposite sides of said support plate and aligned with said hole to detect the sheets passing into said purge bin.

5. The transport system as claimed in claim 4 in which said first and second endless belts have cross members thereon to facilitate the transfer of sheets to said entrance.

* * * * *